US011299330B2

(12) United States Patent
Lebon et al.

(10) Patent No.: US 11,299,330 B2
(45) Date of Patent: Apr. 12, 2022

(54) CONTAINER WITH OUTER CAP FOR A CHILD-RESISTANT CLOSURE

(71) Applicant: AIRNOV, INC., Wilmington, DE (US)

(72) Inventors: Jacquy Lebon, Challands (FR); Dominique Bois, Montreuil aux Lions (FR)

(73) Assignee: AIRNOV, INC., Wilmington, DE (US)

( * ) Notice: Subject to any disclaimer, the term of this patent is extended or adjusted under 35 U.S.C. 154(b) by 0 days.

(21) Appl. No.: 16/623,821

(22) PCT Filed: Jun. 22, 2018

(86) PCT No.: PCT/EP2018/066754
§ 371 (c)(1),
(2) Date: Dec. 18, 2019

(87) PCT Pub. No.: WO2018/234544
PCT Pub. Date: Dec. 27, 2018

(65) Prior Publication Data

US 2020/0385182 A1 Dec. 10, 2020

(30) Foreign Application Priority Data

Jun. 22, 2017 (EP) ..... 17177381

(51) Int. Cl.
*B65D 50/04* (2006.01)
*B65D 41/04* (2006.01)
(Continued)

(52) U.S. Cl.
CPC ..... *B65D 50/041* (2013.01); *B65D 41/0414* (2013.01); *B65D 51/244* (2013.01);
(Continued)

(58) Field of Classification Search
CPC ..... B65D 50/041; B65D 41/0414; B65D 51/244; B65D 55/024; B65D 2401/15;
(Continued)

(56) References Cited

U.S. PATENT DOCUMENTS 3,394,829 A * 7/1968 Peterson ..... B65D 50/041 215/220
3,472,410 A 10/1969 Turner
(Continued)

FOREIGN PATENT DOCUMENTS

AU 7414787 A 7/1988
CN 201419846 Y 3/2010
(Continued)

OTHER PUBLICATIONS

International Search Report with Written Opinion of the International Searching Authority, dated Nov. 20, 2018, with respect to International Application No. PCT/EP2018/066754.

*Primary Examiner* — J. Gregory Pickett
*Assistant Examiner* — Niki M Eloshway
(74) *Attorney, Agent, or Firm* — Scott R. Cox

(57) ABSTRACT

A child-resistant closure for a container with an outer screw thread opening, including an outer cap with a first sidewall and a first top wall and an inner cap with a second sidewall and a second top wall, the inner cap being coaxially nested within the outer cap and being provided with an inner thread to screw the inner cap onto the container. The outer cap and the inner cap include a first cooperating engagement means, and a second cooperating engagement means wherein the second cooperating engagement means includes a plurality of strip-like elastic members wherein each strip-like elastic member is inclined relative to the first top wall and includes a reinforcing element arranged between the first or second top wall and the strip-like elastic member connected thereto.

25 Claims, 14 Drawing Sheets

(51) Int. Cl.
*B65D 51/24* (2006.01)
*B65D 55/02* (2006.01)

(52) U.S. Cl.
CPC ..... *B65D 55/024* (2013.01); *B65D 2251/009* (2013.01); *B65D 2251/0015* (2013.01); *B65D 2251/04* (2013.01); *B65D 2401/15* (2020.05)

(58) Field of Classification Search
CPC ..... B65D 2251/0015; B65D 2251/009; B65D 2251/04
USPC ..... 215/219, 214, 218, 220
See application file for complete search history.

(56) References Cited

U.S. PATENT DOCUMENTS

| | | | | |
|---|---|---|---|---|
| 3,472,420 | A | 10/1969 | Hiatt | |
| 3,820,676 | A * | 6/1974 | Musci | B65D 50/041 215/220 |
| 3,857,505 | A | 12/1974 | Mumford et al. | |
| 3,887,099 | A * | 6/1975 | Gillman | B65D 50/041 215/220 |
| 3,972,436 | A * | 8/1976 | Grau | C23C 14/3407 215/220 |
| 4,281,771 | A | 8/1981 | Siegel | |
| 4,371,088 | A | 2/1983 | Gach | |
| 4,454,955 | A * | 6/1984 | Kusz | B65D 55/089 215/220 |
| 4,527,701 | A * | 7/1985 | Schaubeck | B65D 50/041 215/220 |
| 4,669,620 | A | 6/1987 | Coifman | |
| 4,801,028 | A | 1/1989 | Puresevic et al. | |
| 5,005,718 | A | 4/1991 | Buono | |
| 5,020,681 | A * | 6/1991 | Kusz | B65D 50/041 215/220 |
| 5,054,633 | A | 10/1991 | Reijenga | |
| 5,148,931 | A | 9/1992 | Minh | |
| 5,520,296 | A | 5/1996 | Freed | |
| 5,588,545 | A * | 12/1996 | King | B65D 41/0414 215/216 |
| 5,605,240 | A | 2/1997 | Guglielmini | |
| 5,667,085 | A | 9/1997 | Ogden et al. | |
| 5,743,419 | A * | 4/1998 | King | B65D 41/0471 215/217 |
| 5,762,215 | A * | 6/1998 | Ogden | B65D 50/041 215/220 |
| 6,085,920 | A * | 7/2000 | Moretti | B65D 41/34 215/220 |
| 8,302,792 | B2 | 11/2012 | Logel et al. | |
| 8,360,257 | B2 | 1/2013 | Sebille et al. | |
| 8,474,634 | B1 * | 7/2013 | Branson | B65D 50/041 215/220 |
| 8,499,949 | B2 | 8/2013 | Lahusen | |
| 9,586,738 | B2 | 3/2017 | Herrbach et al. | |
| 9,650,184 | B2 | 5/2017 | Fily et al. | |
| 2005/0115968 | A1 | 6/2005 | Myhre | |
| 2006/0108381 | A1 | 5/2006 | Hoepner et al. | |
| 2007/0084735 | A1 | 4/2007 | Lancesseur et al. | |
| 2007/0108210 | A1 | 5/2007 | Alvares et al. | |
| 2007/0272646 | A1 | 11/2007 | Lancesseur et al. | |
| 2008/0251573 | A1 | 10/2008 | Nobilet et al. | |
| 2010/0288765 | A1 | 11/2010 | Herrbach et al. | |
| 2011/0062176 | A1 | 3/2011 | Lourenco et al. | |
| 2018/0118423 | A1 | 5/2018 | Bois et al. | |
| 2018/0346211 | A1 * | 12/2018 | Painchaud | B65D 47/2081 |
| 2019/0344938 | A1 * | 11/2019 | Lebon | B65D 55/024 |

FOREIGN PATENT DOCUMENTS

| | | | |
|---|---|---|---|
| CN | 204096281 | U | 1/2015 |
| DE | 7441556 | U | 6/1976 |
| EP | 0 519 627 | A2 | 12/1992 |
| EP | 0544381 | A2 | 6/1993 |
| GB | 1 483 678 | A | 8/1977 |
| GB | 2141697 | A | 1/1985 |
| GB | 2 167 050 | A | 5/1986 |
| JP | 2011219110 | A | 4/2011 |
| WO | WO 8500344 | A1 | 1/1985 |
| WO | WO8902858 | A | 4/1989 |
| WO | WO 9418087 | A1 | 8/1994 |
| WO | WO9928205 | A1 | 6/1999 |
| WO | WO2005007526 | A1 | 1/2005 |
| WO | WO2006026836 | A1 | 3/2006 |
| WO | WO2009138128 | A1 | 11/2009 |
| WO | WO2011039400 | A1 | 4/2011 |

* cited by examiner

CONTAINER WITH OUTER CAP FOR A CHILD-RESISTANT CLOSURE

FIELD OF THE INVENTION

The invention relates to an outer cap for a child-resistant closure, a child-resistant closure. Further, the invention relates to a container with such closure and its specific use.

PRIOR ART

Child-resistant closures are predominantly used for containers holding substances which might be harmful to children, especially when coming in contact with skin irritating substances or when swallowing poisonous or pharmaceutically active substances.

Child-resistant safety devices for screw closures of containers have been used for many years.

A further safety feature which sometimes is combined with a child resistant closure is an indication whether the closure has already been opened before. For this purpose, tamper-evident indicators are commonly used. For screw caps, the most common tamper-evident indicator is a ring surrounding the lower end of the cap which is connected to the cap by means of a plurality of frangible bridges. When opening the cap for the first time, the frangible bridges are broken disconnecting the tamper-evident ring from the cap. However, such solution requires an adapted container with protruding parts or a peripheral groove close to the threaded neck.

For a child-resistant closure, usually complex operations are designed for opening and closing the closure. Frequently, such complex operations require a certain force which has to be applied in order to open the closure. A complex operation as well as a minimum force required provides for a high child-resistance. However, the operation of a closure should not be become too burdensome or even impossible for people with arthritic ailments.

Further, it might be desirable to reuse at least a part of the closure after refilling of the container, or to change the design of an existing closure. In such cases, the separate provision of at least a part of a multi-part closure is desirable.

DISCLOSURE OF THE INVENTION

It is the object of the invention to provide for a container an outer cap of a closure as well as a closure which should be child-resistant but still convenient to use.

This object is solved by an outer cap for a child-resistant closure of the features of claim 1, a closure with the features of claim 5, a container with such closure and its special use. Preferred embodiments follow from the dependent claims.

According to the invention, an outer cap for a child-resistant closure comprises a sidewall, a top wall and a plurality of strip-like elastic members, wherein each strip-like elastic member comprises a base portion extending generally perpendicularly from the top wall, an inclined portion being inclined relative to the top wall and ending at an end, and, preferably, a reinforcing element arranged between the top wall and the strip-like elastic member connected thereto. The elastic member further comprises a curved transitional portion connecting the base portion and the inclined portion. In other words, the elastic member further comprises a radius between the base portion and the inclined portion Surprisingly, it has been found that the specific design of the elastic members allows for maintaining the child-resistant properties of the closure, even in case that the elastic members have been bent by the application of an excessive torque when closing the closure with such an outer cap. It will not be damaged in case of the use of a high force when opening the closure and will not break even after an elongated period of use. Strip-like elastic means which are inclined relative to the wall to which they are attached and which do not have a basis at which they start perpendicularly from the wall to which they are attached usually have a lower stiffness and are more prone to turn over or twist/wring if they are bent an increased number of times. In this case, the closure becomes inoperable because the inner cap can no longer be driven by turning the outer cap when opening.

The separate outer cap can be used in combination with a suitably designed inner cap so that, depending on the specific needs, the outer cap can be placed on top of an inner cap only in those cases in which it is required to impart child-safety to the closure.

The optional reinforcing element is arranged close to the base portion. It is attached to the top wall of the outer cap. It is preferably a rib which, according to a preferred embodiment, follows the direction of the elastic member. Preferably, the elastic members are curved with a center of curvature being the longitudinal axis of the corresponding container which longitudinal axis also defines the axis of rotation when using the outer cap. Accordingly, the ribs have the same curvature.

The reinforcing rib does not extend over the whole width of the elastic member.

Preferably, the rib is arranged at a lateral side of the elastic member which is the width direction of the strip-like member.

Preferably, the reinforcing elements between the top wall and the strip-like elastic members can be integrally formed with the top wall with a gap between the reinforcing elements and the corresponding elastic members. Such arrangement has the advantage of increasing the resistance to breakage at the base portions of the elastic members without increasing the thickness of the base portions or decreasing the flexibility at the base portion. Indeed, as the reinforcing element is not attached directly to the base portion of the elastic member, it allows a certain flexibility of the base portion and only limits the amplitude of flexing movement of the base portion towards the reinforcing element. Such arrangement allows a greater amplitude of vertical displacement of the outer cap relative to an inner cap compared to an outer cap comprising identical reinforcing elements and elastic members with the reinforcing elements attached to the top wall and the elastic member. Preferably, the wall of the reinforcing elements facing the base portion of the elastic member is generally perpendicular to the top wall of the outer cap. The reinforcing element is preferably centered regarding the base portion of the elastic member. Preferably, the distance d between the reinforcing element and the base portion of the elastic member is at least 0.5 mm. Preferably, the distance d between the reinforcing element and the base portion of the elastic member is not greater than the height of the straight base portion. Preferably, the width W0 of the reinforcing member is selected to fulfill the requirement $W0 \leq \frac{2}{3} T$, with the wall thickness T of the top wall to which the elastic members are connected.

According to an advantageous geometry of the reinforcing element, the rib extends in a circumferential direction, i.e. parallel to the sidewall. The rib can be opposite to the extension of the strip-like member, and preferably has the same angle as the inclined portion of the strip-like member. Thus there is a continuous upper surface of the strip-like member and the rib.

Preferably, the inclined portion is arranged at an angle to the top wall surface to which the elastic member is connected which $20° \leq \alpha \leq 45°$, preferably $25° \leq \alpha \leq 40°$, and most preferably $\alpha$ is about 30°.

According to a preferred embodiment, the thickness t1 of the elastic members at the base portion is t1≤⅔ T, with the wall thickness T of the top wall to which the elastic members are connected. In such a way, the occurrence of undesired depressions at the outer side of the first top wall due to the shrinking of the plastic material can be avoided or at least considerably reduced.

Preferably, the thickness t1 of the base portion is at most 1.5 mm and preferably at most 1.0 mm.

According to a preferred embodiment, the thickness t1 of the elastic member at the base portion is smaller than the thickness t2 of the elastic member at the second end.

Preferably, the width W0 of the fortification rib is selected to fulfill the requirement W0≤⅔ T, with the wall thickness T of the top wall to which the elastic members are connected.

It is further preferred that the height of the base portion the strip-like elastic members in a direction perpendicular to the top wall is at least 0.3 mm, preferably 0.5 mm, more preferably 1.0 mm. Such minimum height has been found to impart a sufficient stiffness to the strip-like elastic members for the common sizes of closures for household containers for pharmaceutical substances.

According to the invention, a child-resistant closure for a container with an outer screw thread opening comprises an outer cap with a first sidewall and a first top wall, and an inner cap with a second sidewall and a second top wall. The inner cap is coaxially nested within the outer cap and is provided with an inner thread to screw the inner cap onto the container. The outer cap and the inner cap are provided with first cooperating engagement means which are arranged and shaped such then when opening the closure, the inner cap is rotated by the outer cap upon application on the outer cap of an axial force plus a turning mechanical torque in a first rotational direction. The child-resistant closure further comprises second cooperating engagement means which are arranged between the first top wall and the second top wall and shaped such that when closing the closure, the inner cap is rotated by the outer cap upon application of a turning mechanical torque in a second rotational direction on the outer cap. The second cooperating engagement means comprises a plurality of strip-like elastic members, wherein each strip-like elastic member is inclined relative to the first top wall and comprises a base portion extending generally perpendicularly from the first or second top wall. Preferably, each strip-like elastic member further comprises a reinforcing element arranged between the first or second top wall and the strip-like elastic member connected thereto.

In order to open such closure, a complex movement is required. The outer cap has to be pushed down relative to the inner cap before it is possible to unscrew the closure from the container. Such complex movement is child-proof.

According to the invention, the closure comprises second cooperating engagement means, the second engagement means being arranged and shaped such that when closing the closure, the inner cap is rotated by the outer cap upon application of a turning mechanical torque in a second rotational direction on the outer cap. When closing the closure onto the container, no childproof function is required. The second cooperating engagement means makes it possible to easily close the closure after its use because the inner cap is rotated by the outer cap upon application of a turning mechanical torque only and without the need for an axial relative displacement between the outer cap and the inner cap.

The second cooperating engagement means comprises a plurality of strip-like members. Such elastic means provided between the inner cap and the outer cap urge the outer cap away from the inner cap in the axial direction. To put it differently, such elastic members have the function to axially move back the outer cap away from the inner cap once the axial force on the outer cap is removed. In order to open the closure, a complex movement is required starting from the pushing down of the outer cap followed by the rotation of the outer cap while maintaining the force pushing down the outer cap. Thus, the elastic members provide for the child resistance of the closure. Further, an inadvertent breaking of the tamper-evident member during shipping and storage can be avoided because the tamper-evident member is urged away from the protruding element.

According to the invention, the second cooperating engagement means arranged between the first top wall and the second top wall comprise a plurality of elastic members in the shape of inclined strips which are designed and arranged to cooperate with suitable elements, preferably a plurality of wedge-shaped elements. When rotating the outer cap in the second rotational direction, the elastic members come into a locking arrangement with the wedge-shaped elements so that the inner cap rotates with the outer cap in the second rotational direction. Wedge-shaped elements have the further advantage that, if the outer cap is rotated in the first rotational direction but without pushing down the outer cap relative to the inner cap, the elastic members slide over the wedge-shaped elements and will generate an audible indication. For the user, the audible indication signals that the outer cap has not been pushed down sufficiently to open the closure. At the same time, the audible indication provides for an additional safety because children who might try to open the closure might be heard by adults who can intervene, and will usually be fascinated by the generated sound so that small children will not have any motivation to operate the container in a different way than that which produces the sound by means of the ratcheting function of the second cooperating engagement means.

It has been found that the specific design of the elastic means as claimed, allows for maintaining the child resistant properties of the stopper, even if the elastic means have been forced by application of an excessive torque when closing the cap. In such case, the elastic means will be returned, but will maintain their function to space away the outer cap from the inner cap. In their original configuration, the inclined portion of the elastic means is extending in screwing direction when starting from the base portion. Once the inner cap has been fully screwed on the container neck, a possible misuse of the cap consists in turning the outer cap into screwing direction, without simultaneous application of a vertical force. In such a case, the elastic means will abut the locking surface of the wedge-shaped element and under application of an excessive torque, the elastic means can be forced. As a result, the inclined portion of the elastic means will then extend in the opposed direction (unscrewing direction) when starting from the base portion, in a substantially symmetrical geometry when compared to their original configuration. This result is obtained from the provision of the substantially perpendicular portion 60*a* attaching the elastic means to the top surface of the inner cap and of the curved transition portion between the perpendicular portion and the inclined portion of the elastic means.

According to a preferred embodiment of the invention, the child-resistant closure further comprises a tamper-evident means comprising a tamper-evident member being a part of the first top wall which is connected to a surrounding region of the first top wall by a frangible means, and a protruding element which is arranged at the first top wall facing the second top wall and/or the second top wall facing the first top wall so as to face the tamper-evident member. In that the protruding element faces the tamper-evident member, the protruding element may be used for breaking the frangible means particularly by an axial movement of the outer cap relative to the inner cap. Alternatively or in addition thereto, the protruding element may be engaged with the opening formed when the tamper-evident member is removed from the first top wall, thereby serving as the engagement means and allowing for rotation of the inner cap by the outer cap when opening the closure. According to a particular embodiment, the protruding element is arranged at least for breaking the frangible means.

The tamper-evident member preferably forms part of the first top wall which is the top wall of the outer cap. The protruding element arranged at the first top wall facing the second top wall and/or arranged at the second top wall facing the first top wall is sized such that the frangible means connecting the tamper-evident member to the surrounding region of the first top wall will be broken upon an axial movement of the outer cap towards the inner cap which is sufficient to bring the cooperating engagement means into an operational position relative to each other. In other words, in order to rotate the inner cap together with the outer cap when unscrewing the closure from a container, the outer cap must be pushed down towards the inner cap over an axial distance which exceeds the axial distance which is required to break the frangible means when first opening the closure.

According to a preferred embodiment, the frangible means comprises frangible bridges between the tamper-evident element and the surrounding region of the first top wall. As an alternative preferred embodiment, the frangible means comprises a continuous or discontinuous weakness of the material between the tamper-evident element and the surrounding region of the first top wall. Both options generate a well-defined strength of the frangible means so that the pushing force required for the first opening of the closure can be adjusted.

More particularly, if the tamper-evident member is connected to the surrounding region of the first top wall by frangible means, cooperation of engagement means for rotating the inner cap by the outer cap can be prevented. Accordingly, it is impossible to rotate the inner cap without breaking the frangible means.

The tamper-evident indication is very easy to notice because it is arranged at the top of the closure. Preferably, the tamper-evident member should have a diameter which is as large as possible. Preferably, the major diameter of the tamper-evident member is at least 60% of the diameter of the outer cap. When opening the closure, the outer cap has to be pushed towards the inner cap. A user who pushes down the outer cap will, under normal circumstances, look onto the top side of the closure so that the tamper-evident member is in a position where it cannot be missed that the closure has been opened before.

Finally, the optional provision of the tamper-evident member forming part of the first top surface is easier to manufacture. There is no need for a breakable ring which determines, in part, the moulding cycle time which is an important factor for such mass products. Furthermore, breakable rings can be easily broken or damaged when assembling or storing the caps before they will be screwed onto the container.

According to a preferred embodiment, the tamper-evident member is not circular and the outer cap is provided with a first landmark element and the inner cap is provided with a second landmark element, the first and second landmark elements being engageable or abuttable to indicate alignment of the protruding element and the tamper-evident member upon rotation of the outer cap relative to the inner cap.

According to a preferred embodiment, the second cooperating engagement means further comprise a plurality of wedge-shaped elements, wherein the wedge-shaped elements and the strip-like elastic members are dimensioned and arranged such that when rotating the outer cap in the second rotational direction, the elastic members come into a locking arrangement with locking surfaces of the wedge-shaped elements so that the inner cap rotates with the outer cap in the second rotational direction.

The elastic members comprise a basis starting at which the elastic members are attached to the first top wall, wherein the elastic members extend at the basis generally perpendicularly to the first or second top wall, an inclined portion ending at a second end, and, preferably, a curved transitional portion between the basis (or base portion) and the inclined portion. The optional reinforcing element is preferably a reinforcing rib between the first or second top wall close to the basis and the inclined portion.

Such elastic member has an increased strength and robustness. Strip-like elastic means which are inclined relative to the top wall to which they are attached and which do not have a basis at which they start perpendicularly from the top wall usually have a lower stiffness and are more prone to turn over or twist/wring if they are bent an increased number of times. In this case, the closure becomes inoperable because the inner cap can no longer be driven by turning the outer cap when opening. Further, the reinforcing rib acts as a fortification member which further strengthens the elastic members and stabilizes the angular orientation of the strip-like member. It has been found that such a shape does not only provide for an increased strength but also generates a relatively loud clicking noise if a plurality of such elastic members slide over the inclined surfaces of the wedge-shaped members. However, the intensity of the clicking noise can also be increased by other factors like the stiffness of the plastic material and the width and thickness of the elastic means, which lead to a higher spring back elasticity of the elastic members. Preferably, the reinforcing ribs follow the curved shape of the elastic members and extend in a curved circumferential direction, i.e. parallel to the sidewall.

Preferably, the child-resistant closure is characterized in that the thickness of the elastic member at the base portion is smaller than the thickness of the elastic member at the second end.

According to a preferred embodiment, the number of elastic members is twice the number of wedge-shaped elements, and preferably the angle between corresponding portions of the adjacent wedge-shaped elements is less than 40°.

Preferably, the child-resistant closure is characterized in that the inclined portion is arranged at an angle to the top wall surface to which the elastic member is connected which is $20° \leq \alpha \leq 45°$, preferably $25° \leq \alpha \leq 40°$, and most preferably $\alpha$ is about 30°.

According to a preferred embodiment, the child-resistant closure is characterized in that the thickness t1 of the elastic members at the base portion is t1≤⅔ T, with the wall thickness T of the top wall to which the elastic members are connected. In such a way, the occurrence of undesired depressions at the outer side of the first top wall due to the shrinking of the plastic material can be avoided or at least considerably reduced.

Preferably, the child-resistant closure is characterized in that the width W0 of the fortification rib is selected to fulfill the requirement W0≤⅔ T, with the wall thickness T of the top wall to which the elastic members are connected.

Preferably, the height of the locking surfaces of the wedge-shaped elements is at least 0.8 mm.

According to a preferred embodiment, the noise created by the elastic members sliding over the wedge-shaped elements when turning the outer cap in the first direction without applying the axial force is of about 50 dB or more, preferably of about 70 dB (A) or more.

According to a preferred embodiment, the axial force required to bring into engagement the first engagement means exceeds 10 N.

Preferably, the first engagement means are arranged between the first top wall and second top wall, respectively. Such arrangement places the engagement means close to the position where a user applies the pushing force for axially displacing the outer cap. As a result, a failsafe operation can be achieved even when using a material for the caps which has a higher resilience or considering fatigue of the material.

Preferably, the tamper-evident member and/or the surrounding region is provided with an opening which is sized to allow the passage of the tip of a finger. Such opening allows the user to conveniently remove the tamper-evident member. More preferably, the opening is provided on the tamper-evident member so that a user can use the tip of the finger inserted into the opening to apply an upwards direction pressure on the tamper-evident member. Alternatively the tamper-evident member is provided with a seizure member to grip the tamper-evident member for removing. For example a tongue, ring or latch, may be provided to grip the tamper-evident member for removing. If the protruding element is not used to separate the tamper-evident member from the surrounding region of the outer cap, the opening or the tongue/latch may also be used for breaking the frangible means. Furthermore, such opening or tongue/latch facilitates the removal of the tamper-evident member before the closure is first opened. In such a way, specific closures can be designed such that the force required for pushing down the outer cap towards the inner cap can be minimized. Such specific closures can be advantageous e.g. for closing a container for medication for arthritic persons.

According to a preferred embodiment, the first side wall and the second side wall comprise cooperating locking elements to prevent a removal of the outer cap from the inner cap once assembled, the cooperating locking elements preferably being a continuous or discontinuous bead on the inner side of the first side wall of the outer cap and a continuous or discontinuous rib on the outer side of the second side wall of the inner cap. Alternatively, the cooperating locking elements may be formed by the combination of a protrusion on the outer/inner side of the second/first side wall of the inner/outer cap engaging with a corresponding groove on the inner/outer side of the first/second side wall of the outer/inner cap, respectively.

Preferably, the outer cap is made of a transparent plastic material which makes it easier for the user to align the shapes and positions of the inner cap and the outer cap.

The strip-like elastic members can be made of a shape-memory resilient material and can be moulded with the outer cap. Alternatively, it can be joined to the first top wall by bonding or over-moulding.

The inventive closure is suitable for all types of screw-necked bottles or containers. There are no specific requirements for the shape of the neck of the bottle or container except for the provision of an outer thread.

Further, the inventive closure makes it easily possible to provide a desiccating element at the inner side of the closure, i.e. the surface of the second top wall of the inner cap which faces the interior of the container when the inventive closure is screwed onto a container.

According to a preferred embodiment of the invention, the child-resistant closure further comprises a means for holding an active material, the active material preferably being a desiccant or oxygen scavenger. The active material can be any substance or a mixture of individual substances able to trap and/or release a gas which can be moisture, oxygen or an odor just to give some examples. Examples of desiccating agents are silica gel, molecular sieve, clay or other zeolites or a mixture thereof. Examples of oxygen scavengers are iron-based oxygen scavengers, organic oxygen scavengers, enzymatic scavengers, unsaturated polymers or a mixture thereof.

Preferably, the means for holding an active material is a chamber. The chamber can be integrally formed with the inner cap.

Alternatively, the means for holding an active material is a receptacle for the attachment of a canister provided on a side of the second top wall opposite to that facing the first top wall. Thus, the canister is attached on that surface of the second top wall which, when the closure is mounted on a container, faces the interior of the container.

According to a preferred embodiment of the invention, the inner cap is provided with a sealing member which, when the closure is screwed onto a container, is arranged to provide a hermetic seal between the inner cap and the opening of the container. The sealing member can be a gasket arranged to provide a hermetic (moisture tight) seal between the inner cap and the upper surface of the sidewall of the container or any other kind of seal that can be integrally molded or assembled. Preferably, the sealing member is a ring-shaped inner sealing skirt which, when the closure is screwed onto a container, is arranged to provide a hermetic seal between the inner cap and the inner circumference of the opening of the container. Preferably, the sealing skirt comprises a slanted sealing surface, more particularly an inwardly slanted external sealing surface. The sealing skirt is preferably provided with an annular protrusion at or close to its distal end. In such a way, the closure prevents the ingress of moisture into the container once the closure has been firmly screwed onto the container. This increases the shelf-life of the content of the container (filled with moisture-sensitive items).

The tamper-evident member can be arranged off-center relative to the first top wall. Such arrangement still makes it possible to provide a clear indication that the closure has been opened before, while leaving sufficient space on the first top wall for other purposes, like the provision of a label.

According to a preferred embodiment, the protruding element is arranged at the second top wall facing the first top wall for breaking the frangible means, and the tamper-evident member and the protruding element have respective shapes and positions to provide a form-fit connection between the surrounding region of the first top wall first top wall and the protruding element. In such a way, the protruding element can have a double function in that, when first opening the closure, it breaks the frangible means, and further serves as a drive element to transmit the rotational torque applied to the outer cap to the inner cap. Accordingly, the protruding element and an opening formed by removing the tamper-evident member may be engaged thereby forming the first engagement means. This approach is particularly beneficial in combination with the use of the elastic members. In this case, the form-fit connection (engagement) between the protruding element and the opening formed by removing the tamper-evident member is only achieved upon application of an axial-force onto the outer cap, whereby the outer cap is moved towards the inner cap against the elastic force of the elastic members. The form-fit connection can be operable by means of a specific geometry not being fully circular and is, in this embodiment, operable in a rotational direction of the protrusion. Alternatively or in addition, the tamper-evident member can be provided in an off-center position in the first top wall as described above which provides for a form-fit operable in the first rotational direction. The latter may provide for the double function described above, even if the geometry of the protruding element is fully circular. In other words, any geometry can be selected to provide the form-fit connection, as long as the tamper-evident member does either not have a circular shape or is not provided in alignment with the center of rotation of the outer cap.

According to another aspect, the side edges of the protruding element or the inner edge of an opening formed when they tamper-evident member is removed may be provided with one or more beveled edge portions and one or more straight edge portions. In particular, the beveled edge portions have a slanted surface slanted relative to the axial direction. The straight edge portions are substantially parallel to the axial direction. Upon rotation of the outer cap in the first rotational direction, a corner edge of the opening or the protruding element slides along the beveled edge portions without transferring the rotational force from the outer cap to the inner cap. The corner edge is sufficiently pressed against the beveled edge portions only upon application of an axial force on the outer cap, whereby the mechanical torque is transferred from the outer cap via the engaged corner edge and beveled edge portions to the inner cap. Accordingly, the inner cap is rotated together with the outer cap by friction forces between the corner edge and the beveled edge portions. In this embodiment, the corner edge and the beveled edge portions being engaged by frictional forces form the first engagement means.

The shape of the protruding member can additionally increase the safety against the opening of the closure by a child. Shapes like a cross or a clover need to be correctly aligned by bringing the outer cap into a correct position relative to the inner cap. In such a way, the required operation for opening the closure becomes even more complex: in a first step, the outer cap has two be rotated relative to the inner cap in order to match the protruding element with the shape of the tamper-evident member. In a second step, the outer cap has to be pushed in an axial direction toward the inner cap. In a third step, the outer cap is rotated and will, by means of the form fit connection, also rotate the inner cap to unscrew the inner cap from the container. Especially the first step might not be possible for a young child even after the child could observe an adult when opening the closure.

A complex shape of the protruding member matching the shape of the tamper-evident member can also be used to represent a symbol or logo.

The protruding element is generally not visible before the first use of the closure. Yet, under certain circumstances, particularly if the outer shape of the protruding element and the tamper-evident member are not fully circular or if the tamper-evident member is arranged off-center relative to the first top wall, it may be required to align the protruding element with the tamper-evident member. This may be perceived difficult if the protruding element and therefore its positional relationship to the tamper-evident member is not visible. This problem may either be overcome by removing the tamper-evident member manually as already disclosed above and only afterwards align the opening formed by removing the tamper-evident member and the protruding element. Alternatively, however, a landmark or point of reference can be provided to indicate to the user the position of the outer cap relative to the inner cap at which the protruding element and the tamper-evident member are properly aligned to each other. This landmark or point of reference can be visual. For example a window may be provided in the outer cap, such as in the first top wall or in the first side wall. The window can be aligned with a mark provided on the second top wall or the second side wall of the inner cap. In addition or alternatively, the landmark or point of reference can be sensitive and/or audible. As a mere example, a combination of a protrusion and a notch may be provided, which in an aligned position of the outer cap and the inner cap, contact each other or are engaged. The protrusion may be provided at one of the outer cap and the inner cap and the notch may be provided at the other of the inner cap and the outer cap, respectively. Upon a contact (abutment) or engagement, the user receives a sensible (feels a click or resistance) or audible (hears a click) feedback, that the outer cap and the inner cap are now perfectly aligned with respect to the protruding element and the tamper-evident member. According to a preferred embodiment, the landmark or point of reference provided on the outer cap is positioned on the tamper-evident member. Accordingly, once the tamper-evident member is removed, also the landmark or point of reference is removed.

According to a preferred embodiment of the invention, the protruding element is arranged at the second top wall facing the first top wall for breaking the frangible means and the protruding element is at least partially of a different color than the first top wall. After the first use, when the tamper-evident member has been removed from the first top wall, the user receives an additional visible indication of the prior opening. The different color can also be used for written information like the inscription "opened". As an alternative, it is also possible to provide the tamper-evident member of a color which is different to that of the remaining part of the first top wall of the outer cap. In such a way, the optical appearance also changes after removal of the tamper-evident member. In this case, the outer cap with its tamper-evident member can be manufactured by bi-injection moulding (two component injection moulding). Yet, a different color in a portion of the inner cap and/or the outer cap can also be obtained by a screen printing (serigraphy), hot image transfer (hot stamping), pad printing (tampography) or hot stamping, etc.

Optionally, the protruding element can comprise written information or symbolics/imagery which may be obtained by using an engraved mould or one of the other possibilities mentioned above with respect to the optical appearance.

Preferably, the closure is made of a plastic material, preferably a polyolefin-based polymer.

The inventive container has the closure as described above fixedly screwed onto an outer screw thread of the container and closing same.

The inventive use of such container is for containing moisture-sensitive items, especially tablets and capsules containing a medical composition, neutraceuticals, herbalism or diagnostic products.

BRIEF DESCRIPTION OF THE DRAWINGS

In the following, specific embodiments of the invention will be described with reference to the accompanying drawings.

DESCRIPTION OF PREFERRED EMBODIMENTS

Figure 1:
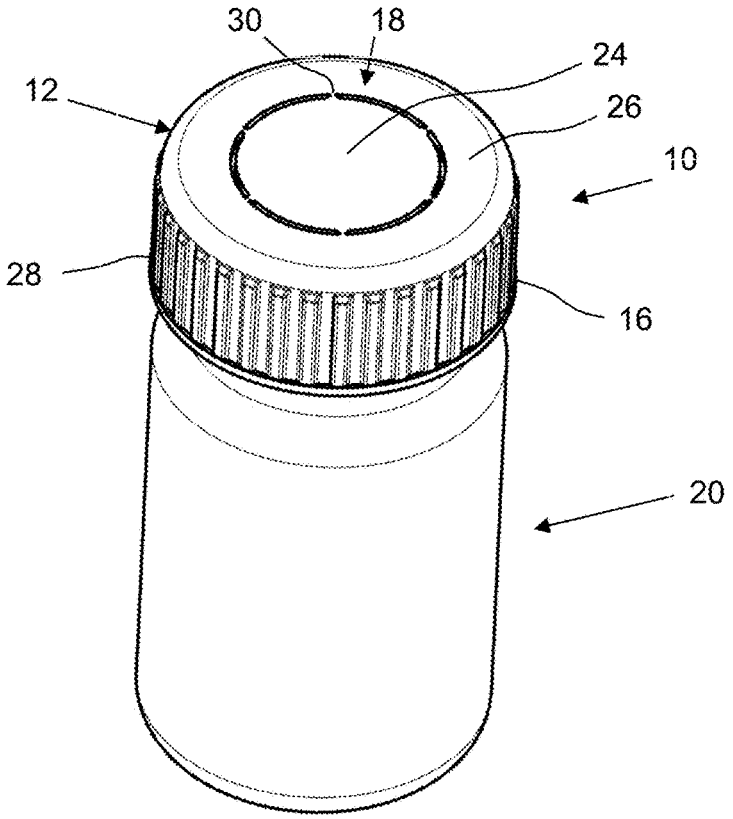
FIG. 1 schematically shows a container with a closure according to the invention.

In the following, some preferred embodiments of the invention will be described. Throughout the drawings, the same elements will be denoted by the same reference numerals.

Figure 3:
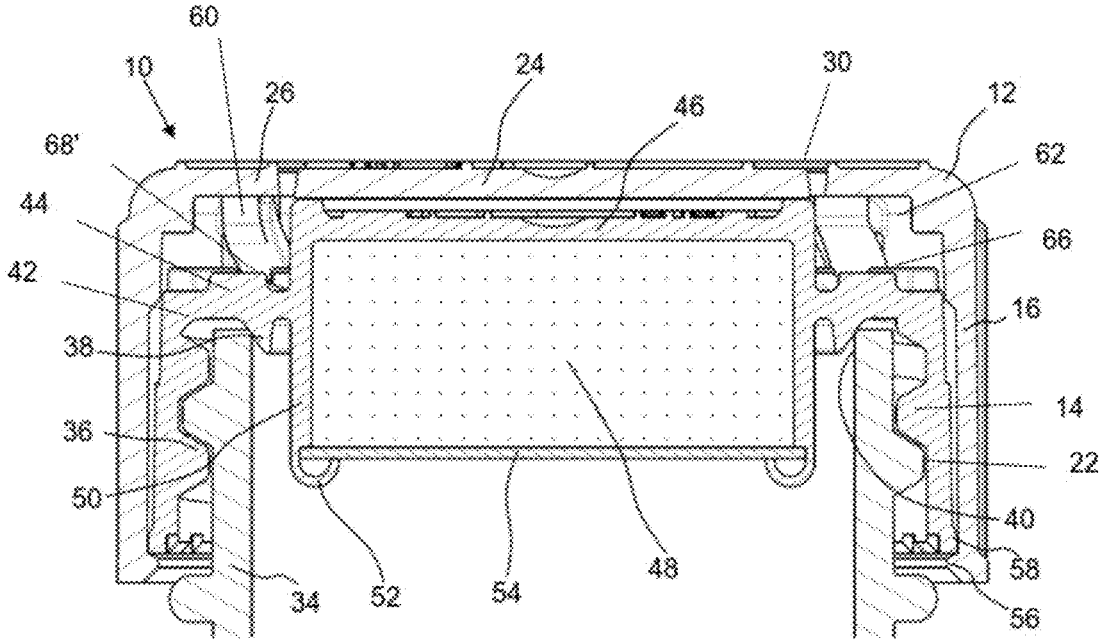
FIG. 3 is a cross-sectional view of a part of an example container with a closure according to a further embodiment of the invention.

FIG. 1 schematically shows a closure 10 according to the invention which is screwed onto a container 20 which, as will be shown in FIG. 3, is provided with an outer thread 22. The container 20 can have any shape as long as it is provided with an opening surrounded by an outer thread 22 which can be used to screw on the closure 10. In the example according to FIG. 1, the container is provided with a neck portion. However, it is also possible to provide the container in the shape of a bottle with a relatively narrow neck or in the shape of a straight cylinder. Likewise, it is possible to provide non-rotational geometries for the container as long as it is provided with an annular outer thread.

The closure 10 consists of two caps which are nested into each other. In FIG. 1, only the outer cap 12 can be seen. The outer cap 12 consists of a first sidewall 16 and a first top wall 18. The first sidewall 16 can be provided with suitable means to increase the grip for a user. In the example according to FIG. 1 a plurality of ribs 28 extending in an axial direction are provided on the first sidewall 16.

The first top wall 18 can comprise a tamper-evident member 24 and a surrounding region 26. The tamper-evident member 24 is connected to the surrounding region 26 by a frangible means 30. The frangible means can be frangible bridges 30 as shown in the examples of FIG. 1 and FIG. 3. As an alternative, it is also possible to fully surround the tamper-evident member 24 by material with a reduced thickness.

Figure 2:
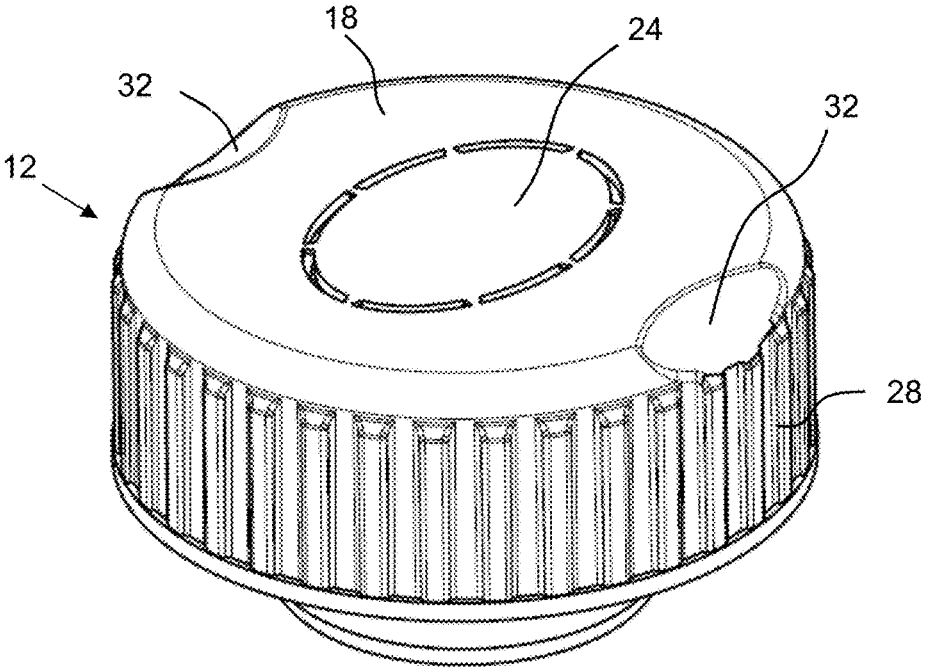
FIG. 2 shows a further embodiment of an inventive closure.

The geometry of the outer cap 12 as shown in FIG. 1 only serves as an example and different geometries are possible. In the schematic example as shown in FIG. 2, the first top wall 18 is provided with depressions 32. Two or more of the depressions 32 may be provided. The depressions 32 can be in positions diametrically opposite to each other or distributed at equal pitch or unequal pitch about the circumference of the first top wall 18. The depressions 32 serve to further improve the grip of a user who, as will be explained in detail below, has to have a firm grip on the outer cap 12 in order to shift it both in an axial direction and thereafter to rotate it. A further difference to the embodiment as shown in FIG. 1 is the provision of an oval tamper-evident member 24 in FIG. 2.

FIG. 3 is a cross sectional view of the neck portion 34 of the container with a closure 10 according to the invention. The closure 10 consists of the outer cap 12 and the inner cap 14. The inner cap 14 is provided with an internal thread 36 the shape of which is adapted to cooperate with the external thread 22 of the container 20. In this manner, the closure 10 can be simply screwed onto the neck of the container by rotation in e.g. a clockwise direction.

The inner cap 14 is provided with a sealing skirt 38 which is arranged so that it establishes a sealing contact with the inner wall surface 40 of that part of the container 20 which surrounds the dispensing opening thereof. The sealing skirt 38 can be provided with an annular, outwardly protruding bead (not shown) in order to further improve the sealing capability of the sealing skirt 38.

The inner cap 14 is provided with a second sidewall 42 and a second top wall 44. The top wall 44 is provided with a protrusion 46. In the example according to FIG. 3, the protrusion 46 has a geometry which corresponds to the geometry of the tamper-evident member 24 being part of the first top wall of the outer cap 12. As will be explained below, the protrusion 46 serves to remove the tamper-evident member 24 by breaking the frangible bridges 30 between the tamper-evident member 24 and the surrounding region 26 once the outer cap 12 will be axially displaced towards the inner cap 14.

The inner cap 14 is further provided with a desiccant chamber 48. It is formed by an annular sidewall 50, also shown in FIG. 4, and suitable closing means 52 in order to close the desiccant chamber 48 with a gas permeable cover 54 which retains the desiccant material inside the desiccant chamber 48. In the example of FIG. 3, the closing means 52 is the end of the annular sidewall 50 of the desiccant chamber 48 which is crimped to hold the gas permeable cover 54. As an alternative not shown in FIG. 3, the inner cap 14 could also be provided with a suitable attachment structure for holding a prefabricated canister containing an active agent according to the specific contemplated use of closure 10.

On the internal side of the first sidewall 16 a radially inwardly extending bead 56 is provided which, in the mounted state of the outer cap 12 on the inner cap 14, forms a positive lock with a radially outwardly extending flange 58 on the second sidewall 42 of the inner cap 14. The bead 56 and the flange 58 cooperate in a way so as to firmly hold the outer cap 12 on the inner cap 14 so that it can no longer be removed from the inner cap 14. The inner cap 14 is provided with elements 66 cooperating with driving members 62 as shown in FIG. 3.

Figure 4:
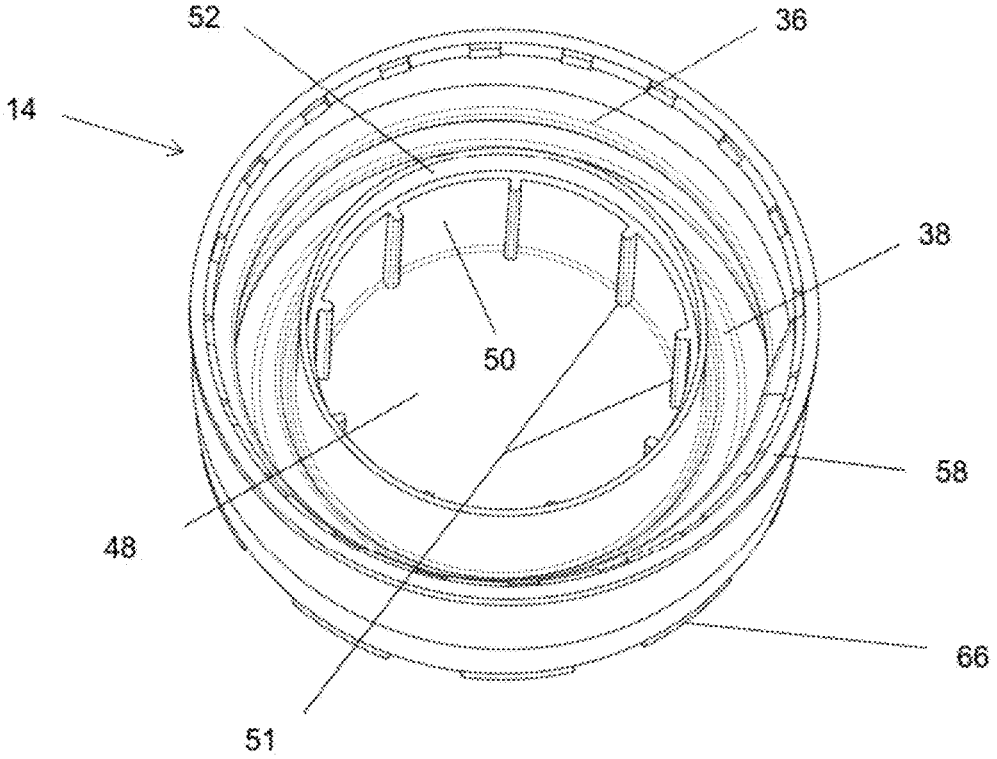
FIG. 4 is a bottom perspective view of the inner cap according to the embodiment of FIG. 3.
Figure 5:
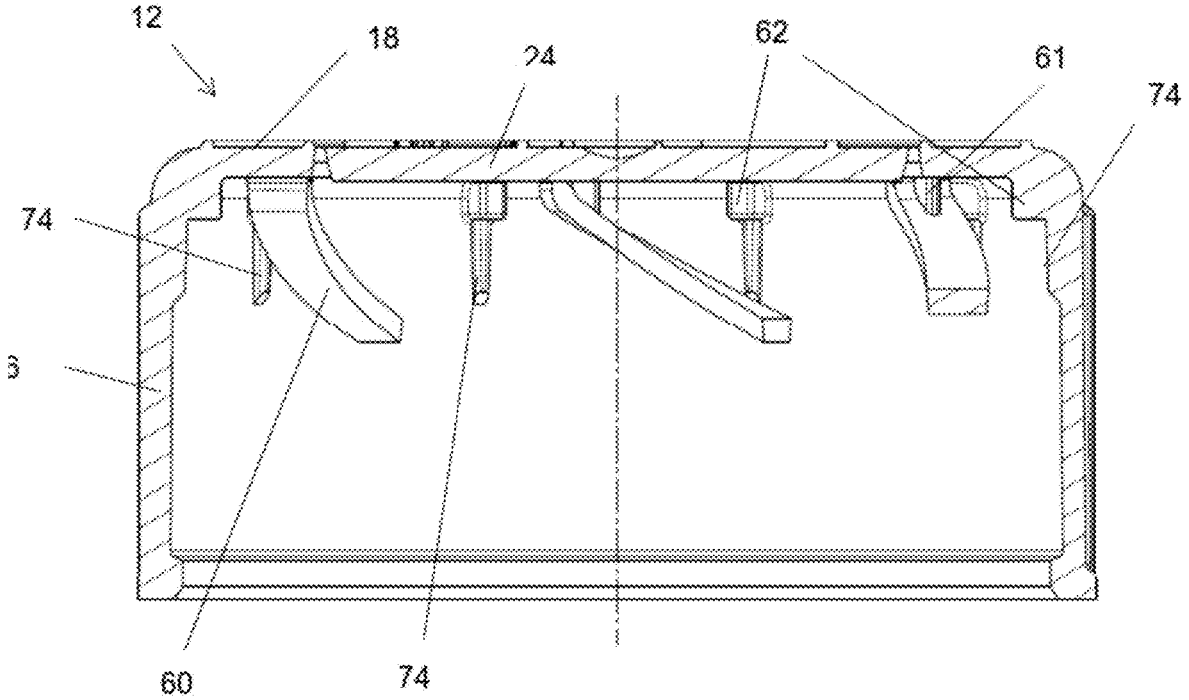
FIG. 5 is a cross-sectional view of the outer cap according to an embodiment of the invention.

FIG. 4 shows the bottom of the inner cap 14, whereas FIG. 5 shows the cross-sectional view of the outer cap 12.

Figure 6:
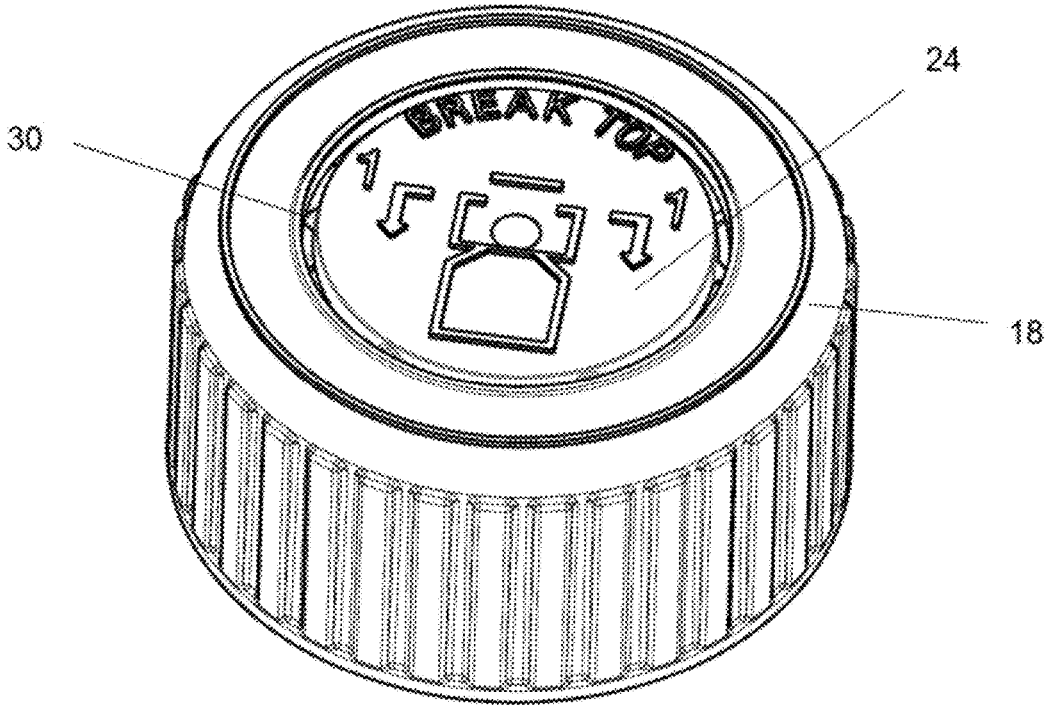
FIG. 6 is a top perspective view of the outer cap.

The top view of the outer cap according to FIG. 6 corresponds to that as already shown in FIG. 1 so that except for a better representation of the frangible bridges 30 in FIG. 6, reference can be made to the detailed explanation of the outer cap 12 in the description of FIG. 1 above.

Figure 8A:
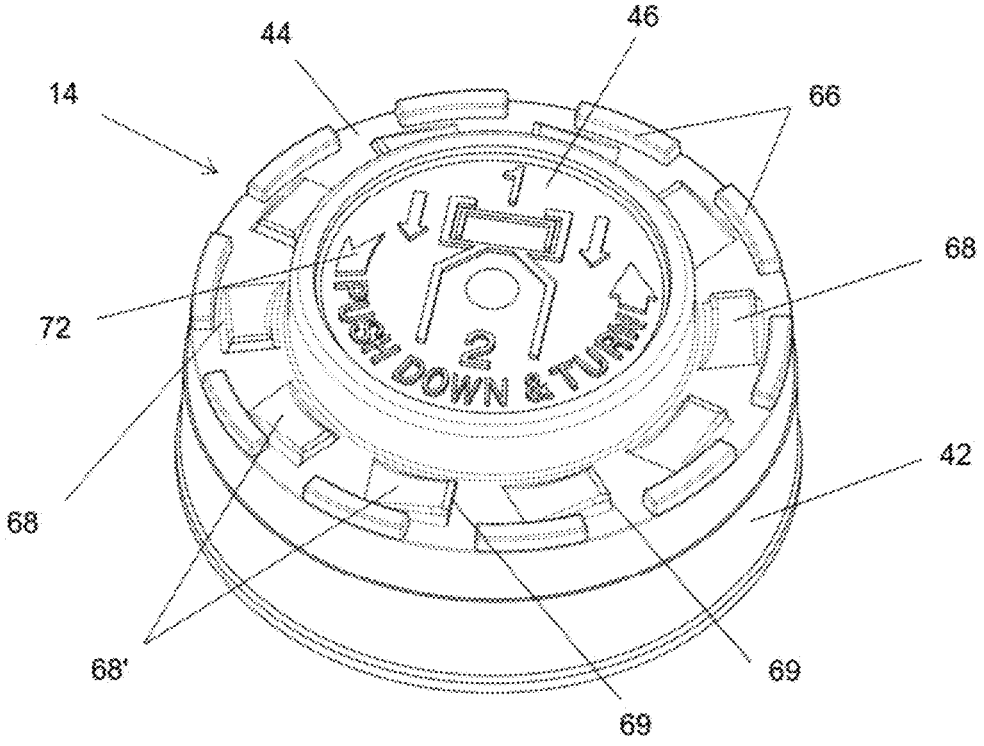
FIG. 8*a* is a top perspective view of the inner cap according to FIG. 7.

FIG. 8*a* shows the protrusion 46 on the second top wall 44. Further, the second top wall 44 is provided with serrations 66 which, in the mounted state, cooperate with the driving members 62 on the outer cap 12, whereby the first engagement means is formed. Extending from the top wall 44 wedge-shaped elements 68' with inclined surfaces 68 and step portions 69 are provided which, in the mounted state, cooperate with the elastic members 60 which will be described in detail below.

In operation, the outer cap 12 and the inner cap 14 nested therein can be rotated together for screwing the closure 10 onto the container 20. The clockwise rotation direction for screwing the closure 10 onto the container brings the elastic members 60 in engagement with the step portions 69. The step portions 69 provide an abutment which interact with the elastic members 60 provided on the internal side of the outer cap 12. This interaction is only possible when closing the closure 10 on the container 20 which is usually in a clockwise direction. When a user rotates the outer cap 12 in a counterclockwise direction in an attempt to open the closure 10, the elastic members 60 slip over the beveled surfaces 68'. As a result, the rotation of the outer cap 12 will not lead to a corresponding rotation of the inner cap 14. However, it should be apparent that the same basic construction and functionalities can be provided in case that the rotational direction for closing and opening the container should be reversed.

An opening of the closure 10 requires that the driving members 62 of the outer cap 12 are brought in engagement with the serrations 66 of the inner cap 14. This is only possible after the outer cap 12 has been axially displaced towards the inner cap 14 against the retaining force of the elastic members 60. Only after the application of a pushing force onto the top surface of the outer cap 12, the driving members 62 can interact with the serrations 66 so that rotation of the outer cap 12 in a counterclockwise direction will also rotate the inner cap 14 in the same direction.

The elastic members 60 act to disengage the driving members 62 and serrations 66 once the axial pressure on the outer cap 12 is released so that the elastic members 60 return to their relaxed position and displace the outer cap 12 in an axial direction away from the inner cap 14.

As a result, the closing of the closure 10 onto a container is easy to achieve and only requires a simple rotational movement of the outer cap 12, whereas the opening of the closure 10 requires a complex operation starting with an axial displacement of the outer cap 12 towards the inner cap 14 under axial pressure, followed by a rotational movement while maintaining the axial pressure. Such complex operation establishes a highly effective child resistance.

When first using the closure 10, the axial displacement of the outer cap 12 towards the inner cap 14 can additionally be used to break the optional frangible means 30 between the tamper-evident member 24 and the surrounding region 26 of the first top wall 18 of the outer cap 12. Thus, when first pushing down the closure 10, the frangible connections of the tamper-evident member 24 are broken and the tamper-evident member 24 separates from the surrounding region 26 of the first top wall 18.

Alternatively, the tamper-evident member 24 may completely manually be removed including breaking the frangible means. For this purpose, a tongue or latch or an opening in the tamper-evident member 24 may be provided. Preferably, the protruding element is used to break the frangible means.

The tamper-evident member 24 can be integrally formed with the first top wall 18 of the outer cap 12. It can be of a different colour and/or material than the surrounding region 26 of the first top wall 18. This can be realized by means of a bi-injection moulding process. It is either possible to first mould the tamper-evident means and then, moulding from the existing mould the surrounding region 26 of the first top wall 18 and the first sidewall 16 of the outer cap 12, or to first mould the outer cap 12 with a hollow space on its top wall and then to mould from the existing mould the tamper-evident member. By using a colour for the tamper-evident member that is different from the colour of the remaining part of the outer cap 12, the tampering becomes more evident.

A preferred solution uses a different colour at least in part for the protrusion 46 of the inner cap 14. After the tamper-evident member 24 has been removed, the different colour of the protrusion 46 can be seen and serves as a clear indication for the tampering.

Preferably, the tamper-evident member 24 is removed after the frangible means has been broken. It can comprise a window allowing the passing of a finger of the user for its easy removal. It can further comprise a seizure member that extends outwardly from the top surface of the tamper-evident member for facilitating its removal before the closure is first opened by the above-described complex operation starting with pushing down the outer cap 12 towards the inner cap 14. In other words, independent of the specific embodiment as described here, the provision of a window for the removal of the tamper-evident member 24 after the frangible means have been broken, or the removal of the tamper-evident member 24 before pushing down the outer cap 12 by means of a seizure member are possible.

Figure 8B:
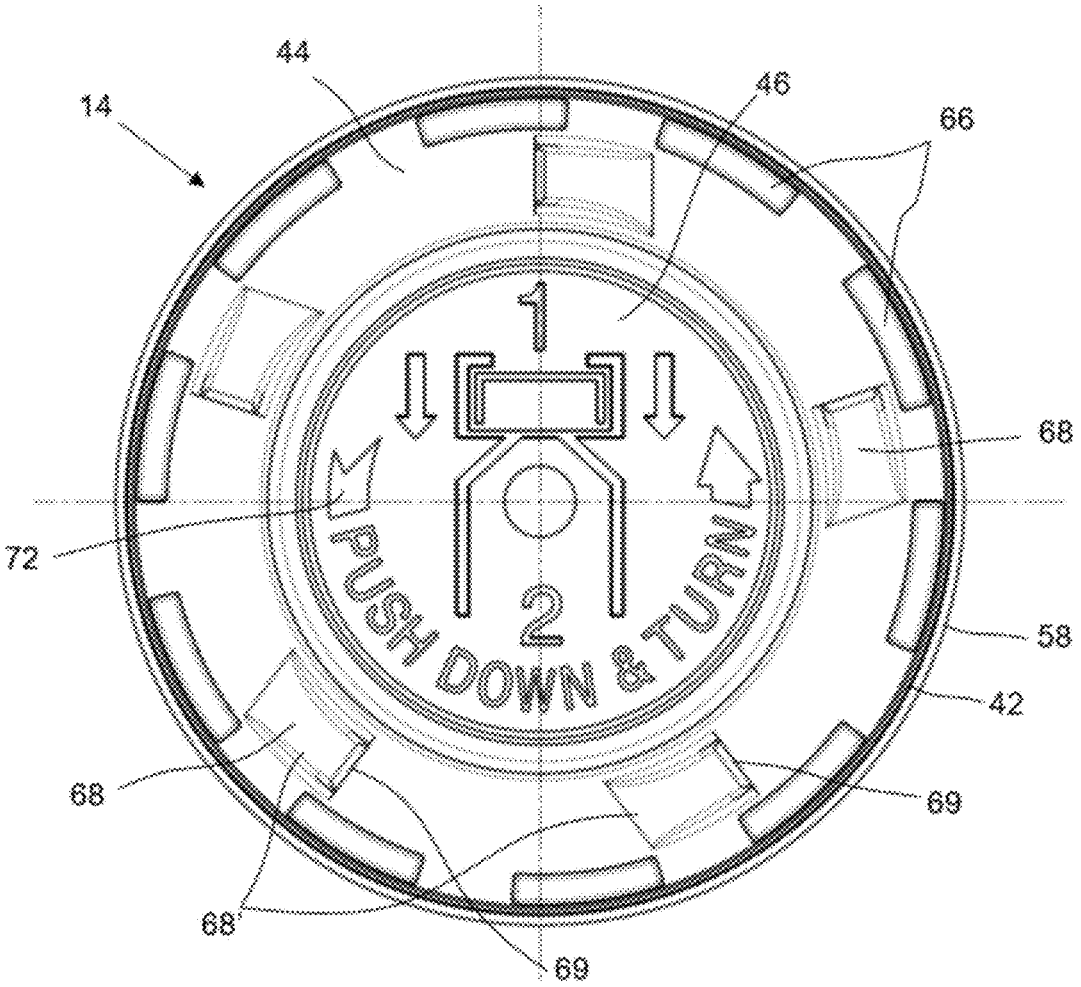
FIG. 8*b* is a further embodiment of an inner cap in top view.

The alternative embodiment as shown in FIG. 8*b* differs from that according to FIG. 8*a* in that, on the one hand, there is only half the number of wedge-shaped elements 68' provided and, on the other hand, the position of the wedge-shaped elements 68' is angularly shifted with respect to the serrations 66. Specifically, the step portions 69 of the wedge-shaped elements 68' are arranged radially inwards relative to serrations 66, respectively. Alternatively, if there should be no positional overlap in the radial direction, the position of the step portions 69 should be selected to that of the serrations 66 such that the distance between the step portions 69 and the adjacent serration is smaller than the thickness t2 of the elastic members 60. Such mutual arrangements of the step portions 69 and the adjacent serrations 66 prevents the elastic members 60 from being forced along the step portions 69 until being displaced or bent radially outwards, when screwing the closure 10 onto the container. Indeed, when the elastic members abut the step portions 69, any outward deviation of the end portions 60*b* is stopped by the presence of a corresponding radially arranged serration 66. In other words, the mutual arrangement of the step portions 69 and the adjacent serrations 66 prevents the situation that, during the screwing, the elastic members 60 could pass between two adjacent serrations 66 and could be deformed by torsion or reversed, thus preventing an effective screwing of the closure onto the container.

In the embodiment as described with reference to FIG. 3, the protrusion 46 is shaped to correspond to the shape of the tamper-evident member 24. However, this is not a requirement and instead of the protrusion 46, one or a plurality of smaller protrusions can be provided while maintaining the same function.

Nevertheless, it can be advantageous to select the shape of the protrusion 46 such that it corresponds to the geometry of the tamper-evident member 24.

Figures 9A, 9B, 9C:
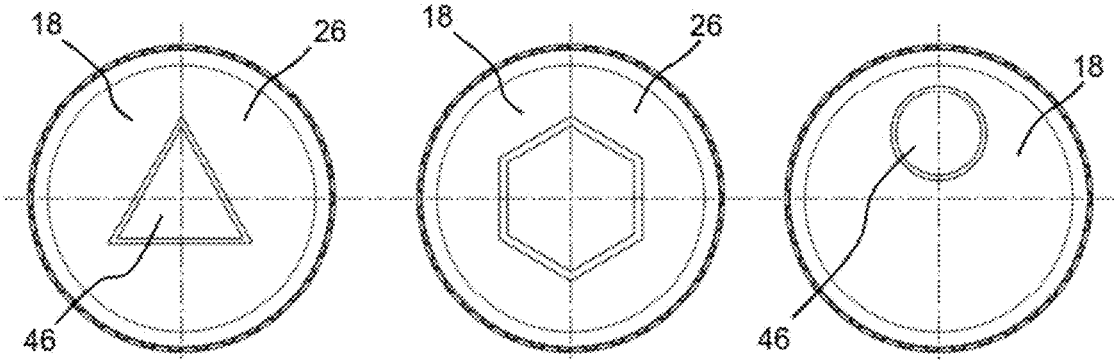
FIGS. 9*a*, 9*b* and 9*c* are schematic top views of various embodiments of the invention.

FIGS. 9*a*, 9*b* and 9*c* schematically describe a further embodiment of the closure 10 in which the cooperating engagement means are provided by the interaction between the protrusion 46 and the surrounding region 26. In such a case, the driving members 62 and the serrations 66 are no longer required because their function as an engagement means is incorporated in the interaction between the protrusion 46 and the surrounding region 26 around the tamper-evident member 24.

Turning now to FIGS. 9*a* and 9*b*, different geometries of the surrounding regions 26 of the first top wall 18 after removal of the tamper-evident member 24, and of the protrusions 46 are shown. It can be seen that the protrusions 46 will provide a form lock interaction with the surrounding region 26 once the outer cap 12 has been axially displaced towards the inner cap 14 so that the protrusion 46 extends through the opening in the surrounding region 26. The form lock interaction between the outer cap 12 and the inner cap 14 allows the unscrewing of the closure 10 from the container 20.

The embodiment according to FIG. 9*c* does not use a mutual geometry of the protrusion 46 and the opening in the surrounding region 26 which automatically generates a form lock interaction, but places the protrusion 46 and the opening in the surrounding region 26 in an off-center position on the first top wall 18 such that a rotation of the outer cap 12 will also rotate the inner cap 14 if the protrusion 46 extends into the opening in the surrounding region 26.

Throughout the embodiments as described above, an additional tamper-evident means is provided. The inner cap 14 is provided with the protrusion 46 which can be used to break the frangible means 30 around the tamper-evident member 24 in the first top wall 18 of the outer cap 12. However, it is also possible to provide a protrusion on that side of the tamper-evident member 24 which, before the frangible means 30 has been broken, faces towards the second top wall 44 of the inner cap 14.

Figure 10:
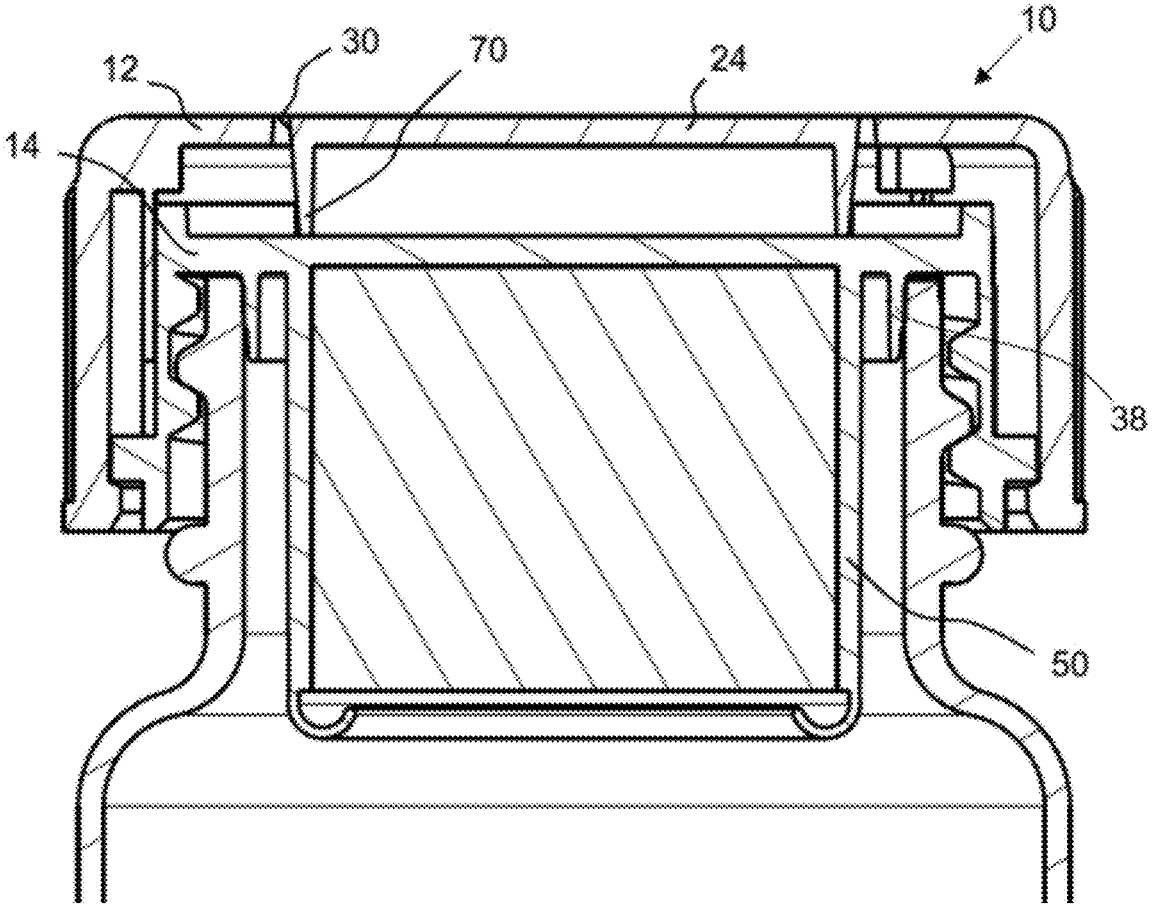
FIG. 10 is a cross-sectional view of a part of an example container with a closure according to a further embodiment of the invention.

FIG. 10 shows a partial cross section of the closure 10 according to a further embodiment of the invention. As can be seen in FIG. 6, the basic elements of the closure 10 are identical or at least very similar to those as described in the context of the embodiment of FIG. 3. The basic difference is the provision of one or a plurality of protruding elements 70 on the tamper-evident member 24. The operation of the closure 10 according to FIG. 10 is the same as that as explained in detail above. An axial displacement of the outer cap 12 towards the inner cap 14 brings the protruding element 70 in abutting contact with the second top wall 44 of the inner cap 14 and breaks the frangible bridges 30 around the tamper-evident member 24.

A further embodiment not shown in the drawings combines the general principles laid down in FIGS. 3 and 10. The provision of a protrusion 46 as shown in FIG. 3 can be combined with the provision of a protruding element 70 as shown in FIG. 10.

Figure 7:
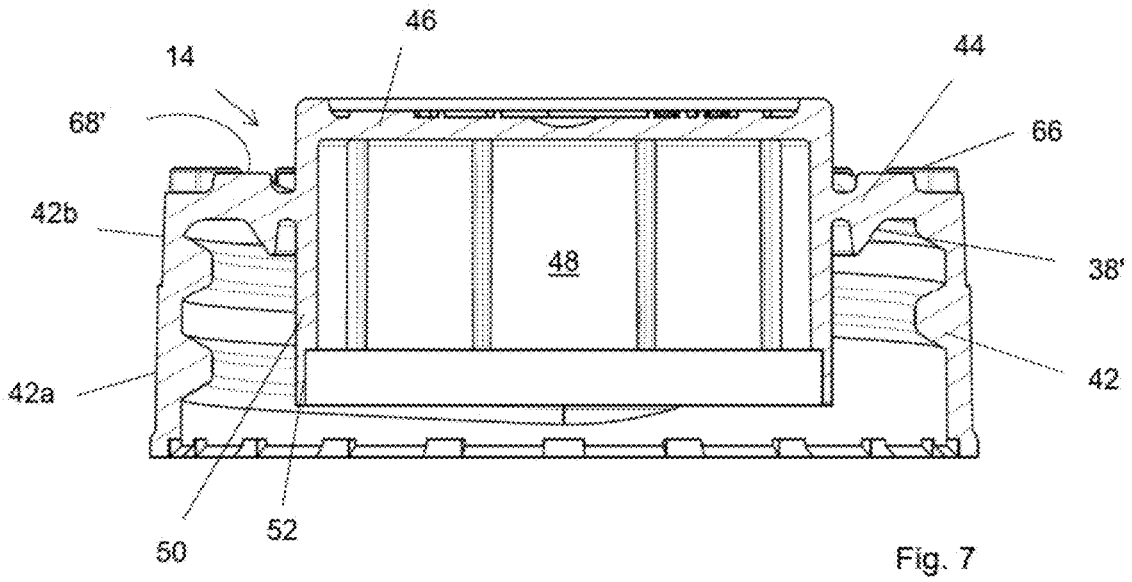
FIG. 7 is a cross-sectional view of the inner cap according to a further embodiment of the invention.

FIG. 7 is a cross-sectional view of the inner cap. Due to the high similarities to the inner cap as shown e.g. in FIG. 3, in the following reference will be made to the specific differences over the inner cap of the closure according to FIG. 3. Firstly, the inner cap 14 is shown as it is molded. The desiccant chamber 48 has not yet been filled with sorbent material, closed with a permeable material, and the closing means 52, which are extensions of the annular wall 50 with reduced wall thickness have not been crimped to close the container. The same inner cap mounted within the closure, wherein the desiccant chamber 48 is filled with sorbent material and closed can be seen in FIG. 20.

A first difference over the geometry of the inner cap as shown in FIG. 3 is the size of the desiccant chamber which can be freely adapted to the specific needs and, in the example of FIG. 7, is smaller than that as shown in FIG. 3. The vertical ribs 51 as shown in FIG. 4 are provided in order to improve the support of the closing means 54 (see FIG. 3), which is often made of cardboard, once the desiccant chamber has been filled with sorbent material.

The inner cap 14 according to FIG. 7 also has a sealing skirt 38 which has an inwardly slanted external sealing surface 38'. The inwardly slanted external sealing surface promotes the tightness of the inner cap when used on standardized bottles or containers. This is based on the fact that the inwardly slanted external sealing surface can be more easily adapted to different dimensional variations of the bottle or container on which the inventive closure is used. Because of the slanted sealing surface, the sealing contact is likely to be a line contact only so that tolerances and even small irregularities of the dimensional variations of the neck of the bottle or container can be accounted for. As can be seen in the mounted state on an example container as shown in FIG. 20, there is a line contact between the sealing surface and the inner edge of the neck of the container which provides a better sealing contact due to the deformation of the sealing surface along the contact line. Further, dimensional variations in the thickness of the mouth of the container can easily be adapted.

A further feature which can be best seen in FIG. 7 is the provision of a small step in the outer diameter of the inner cap. In other words, the outer surface of the second sidewall 42 comprises a region 42*a* with a slightly lager outer diameter and a second region 42*b* in which the outer diameter of the inner cap slightly smaller. This difference of the outer diameter of the inner cap allows an easy and quick assembly of the inner cap into the outer cap and reduces the reject rate. Since the region 42*b* with the smaller diameter is closer to the top of the inner cap as compared to the region

42*a* with a larger diameter, it is easier to center the inner cap for the assembly within the outer cap. If the orientation of the inner cap relative to the outer cap is not perfectly centered, the inner cap will still enter the outer cap and is self-centered therein during assembly. This simplifies a high-speed process of assembly.

Like in the embodiment according to FIG. 3, the wedge-shaped elements with the inclined surfaces 68' are on the top wall 44 of the inner cap. The advantage of such position of the inclined surfaces 68' is that the inner diameter of the outer cap can be designed to be close to the outer diameter of the inner cap because no interacting elements have to be positioned between the sidewalls, Thus, the inventive closure can be designed with a small outer diameter of the outer cap and is compact.

Figure 13:
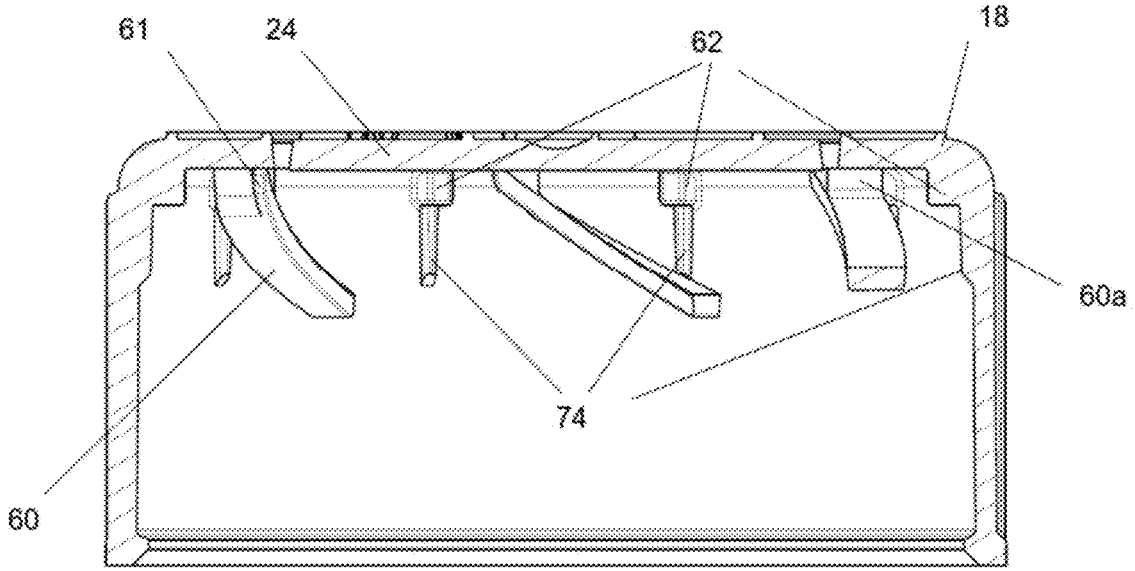
FIG. 13 is a variant of the embodiment according to FIG. 12 and shows a cross-sectional view along line A-A in FIG. 14.

In this example, there are about 5 wedge-shaped elements with inclined surfaces 68' distributed over the second top wall 44. The number of wedge-shaped elements should be sufficiently high such that the angle between two consecutive step portions 69 is not too high, preferably less than 75°. Indeed, it is preferable that, during the closing (by screwing the cap without applying downward pressure on the outer cap), a minimum of rotation of the outer cap is sufficient to carry the inner cap by cooperation of step portion 69 of the wedge-shaped elements 68 with the end portion 60*b* of the elastic members 60 of the outer cap (for example the elastic members as shown in FIG. 5, FIG. 13 or FIG. 20C). At the same time, the number of wedge-shaped elements should not be too high because the wedge-shaped elements should be sufficiently spaced from each other such that, when the elastic members are flattened during downward pressure (for example for opening the closure), an elastic member should not be in contact with two consecutive wedge-shaped elements simultaneously. Preferably, the distance between two consecutive step portions 69 is greater than the length of the elastic member 60. Indeed, the elastic members 60 have a certain length and height. They can be better flexed toward the top wall 18 of the outer cap 12 if there is sufficient space to accommodate the elastic members 60 once they are bent such that their inclined portion 60*c* extends essentially parallel to the top wall 18 of the outer cap 12. The greater the vertical displacement between the outer cap 12 and inner cap 14 is supposed to be, the more accommodation space for the bent inclined portions of the elastic members is required. A greater vertical displacement might be desirable for more easily breaking a tamper-evident element 24 on the top wall 18 of the outer cap 12.

Preferably, the number of wedge-shaped elements is twice the number of the elastic members 60. Therefore, during opening and without applying a downward pressure, the elastic members 60 slide over the inclined surfaces 68' and give an audible indication when snapping down the step portions 69 as soon as the outer cap 12 has been rotated by around 36° or less relative to the inner cap 14. Preferably, there are at least 10 audible indications per revolution.

During the closing operation, the free end of the elastic members 60 move down the inclined surfaces 68' and will be stopped at the step portions 69. In this way, the closing can be carried out by a simple rotation of the outer cap without requiring a downward pressure. The height of the step portions 69 is preferably at least 0.8 mm.

Further, in the embodiment according to FIG. 8, a number of serrations 66 have been provided which is as high as the number of wedge-shaped elements 68. Such a high number of serrations 66 contributes to a more efficient opening of the closure once the driving members 62 (see FIGS. 13 and 14) of the outer cap were brought in engagement with the serrations 66 of the inner cap 14. Preferably, the number of the serrations 66 should be at least 10. Preferably, the angle between the same point of two consecutive serrations 66 should be less than 40°.

Turning now to FIG. 5, a cross-section of the outer cap suitable for the inner cap as shown in FIGS. 4, 7 and 8 is shown. As described above, the outer cap 12 is provided with a first sidewall 16, a first top wall 18 and a tamper-evident member 24. There are driving members 62 for cooperating with the serrations 66 in the process of opening the closure.

Figure 14:
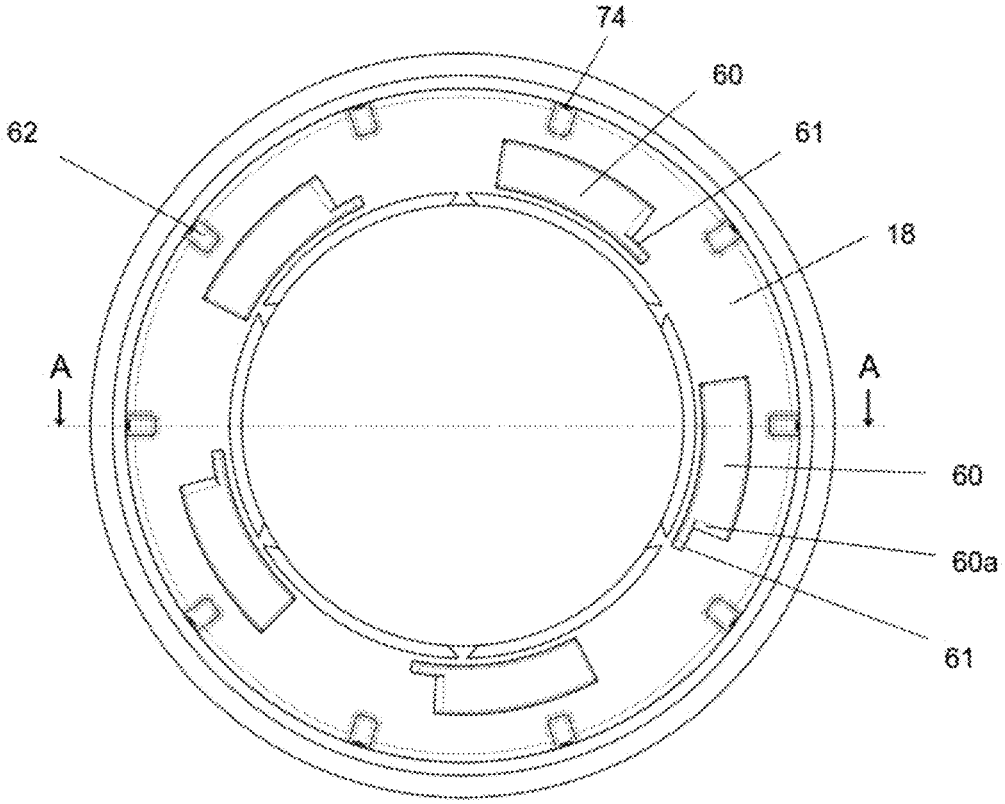
FIG. 14 is a top view of the outer cap according to FIG. 13.

Further, the outer cap is provided with centering ribs 74, which can also be seen in FIGS. 13 and 14. Due to the difference of the outer diameter of the inner cap along the height of the inner cap, the ribs 74 are provided to re-center the inner cap inside the outer cap after it has been assembled. Thus, the gap between the inner diameter of the sidewall of the outer cap and the outer diameter of the inner cap in the region 42*b*, in which the outer diameter of the inner cap is slightly decreased, is compensated by the centering ribs 74 whose length is also adapted to extend over at least a major part of the height of the region 42*b*.

As can be further seen in FIG. 5, the elastic members 60 have a basis 60*a* at which they are attached to the top wall of the outer cap. The basis 60*a* extends substantially perpendicularly from the top wall followed by a transitional section in which the elastic member 60 changes its direction into the angular position as shown. In order to impart a sufficient strength to the elastic members 60, a reinforcing rib 61 is provided which extends between the lower surface of the top wall 18 and the elastic member 60 close to its starting end of the basis 60*a* where it is attached to the top wall 18. The reinforcing rib 61 preferably does not extend over the whole width of each elastic member 60.

The elastic member 60 according to the present embodiment has an increased robustness. It will not be damaged in case of the use of a high downward pressure and will not break even after an elongated period of use. In case that the elastic means should break, this will have the consequence that the inner cap can no longer be reclosed simply when rotating the outer cap.

Figure 12:
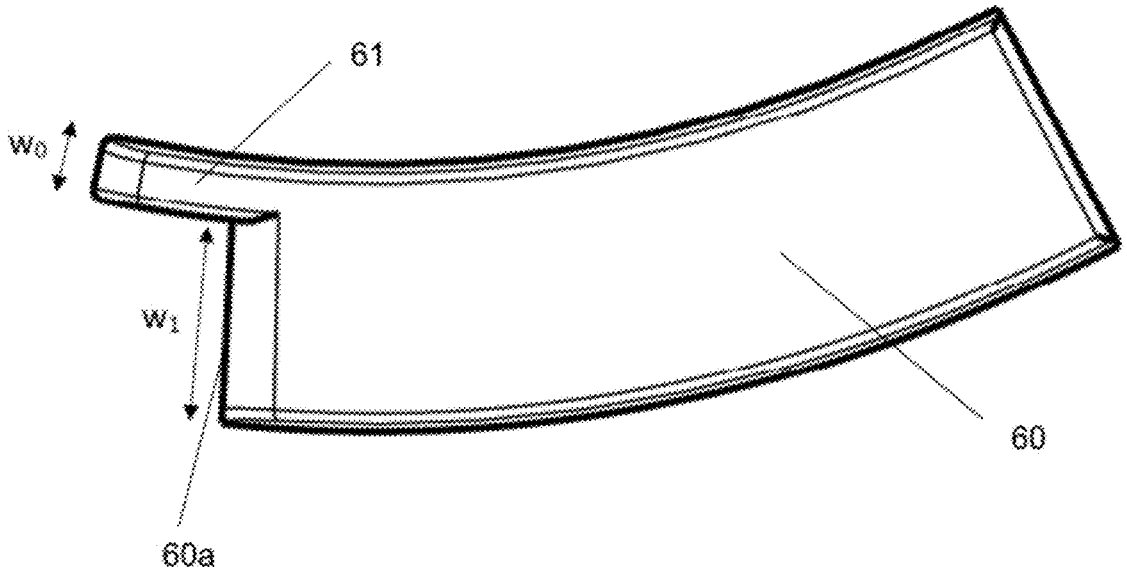
FIG. 12 shows a top view in the elastic member according to the embodiment of FIG. 13.

In FIG. 13, a cross-sectional view of the outer cap is shown which has a high similarity to that as shown in FIG. 5. What is different is the geometry of the elastic members 60 close to their basis where they are attached to the lower side of the top wall 18. FIG. 13 is a cross-sectional view along the line A-A of FIG. 14. In the embodiment of FIG. 13, the basis 60*a* of the elastic means 60 also extends substantially perpendicularly from the lower surface of the top wall 18. This can also be seen in FIGS. 12, 15 and 16. In FIG. 14, the basis 60*a* of the elastic members 60 can be seen. In addition to this, a reinforcing rib 61 is provided which, as can be best seen from the top view as shown in FIG. 12 has a width which is smaller than that of the basis 60*a* and is arranged next to the basis 60*a* in a width direction of the elastic member 60.

As can be seen from FIG. 14, there are only five elastic members 60 provided on the lower surface of the top wall 18, whereas in FIG. 8 there are ten inclined surfaces. The total numbers are of minor importance but it is preferred that the number of inclined surfaces is twice the number of the elastic members. Preferably, the space between two consecutive elastic means is substantially the same as an elastic means. Furthermore, it can be seen that the rib 61 extends in a circumferential direction which is opposite to the extension of the elastic member.

Figure 11:
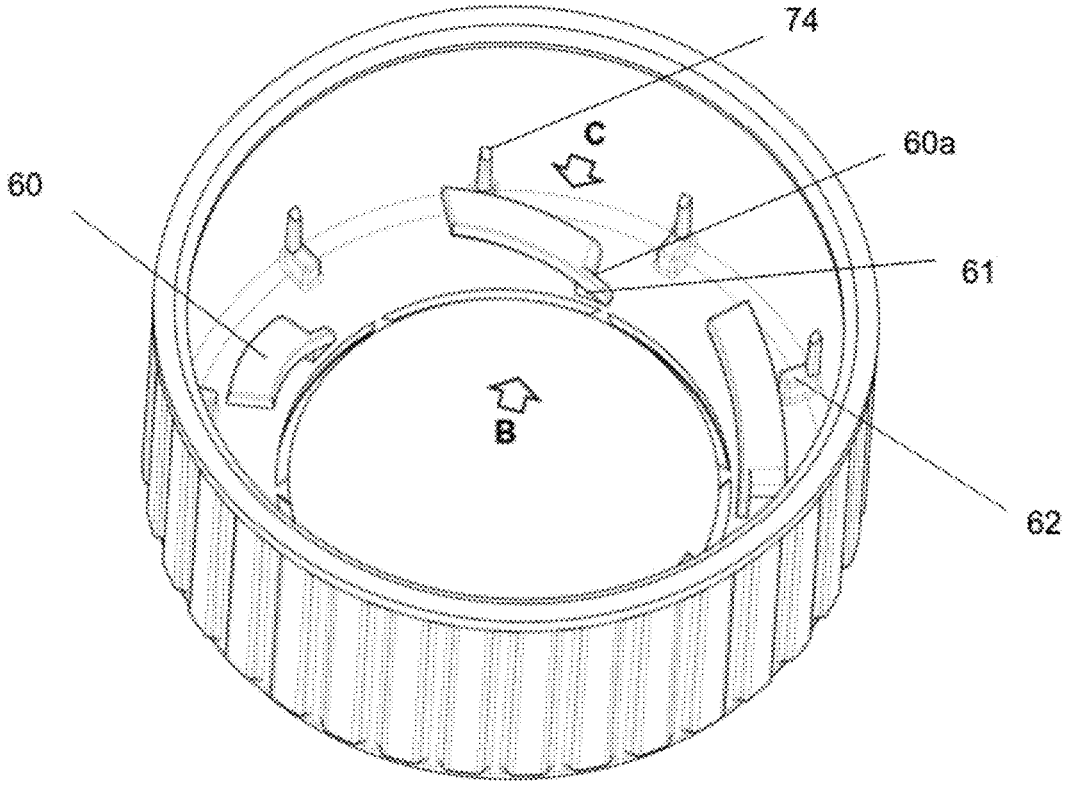
FIG. 11 is a bottom perspective view of the outer cap according to FIG. 13.
Figure 15:
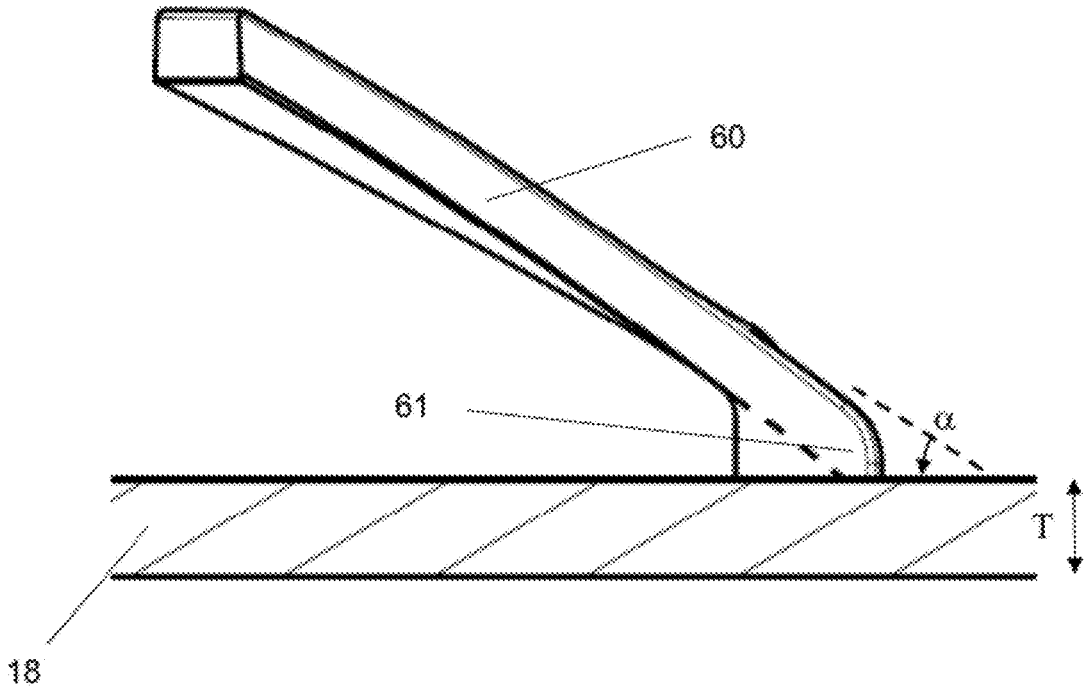
FIG. 15 is a view in the direction of arrow B in FIG. 11.
Figure 16:
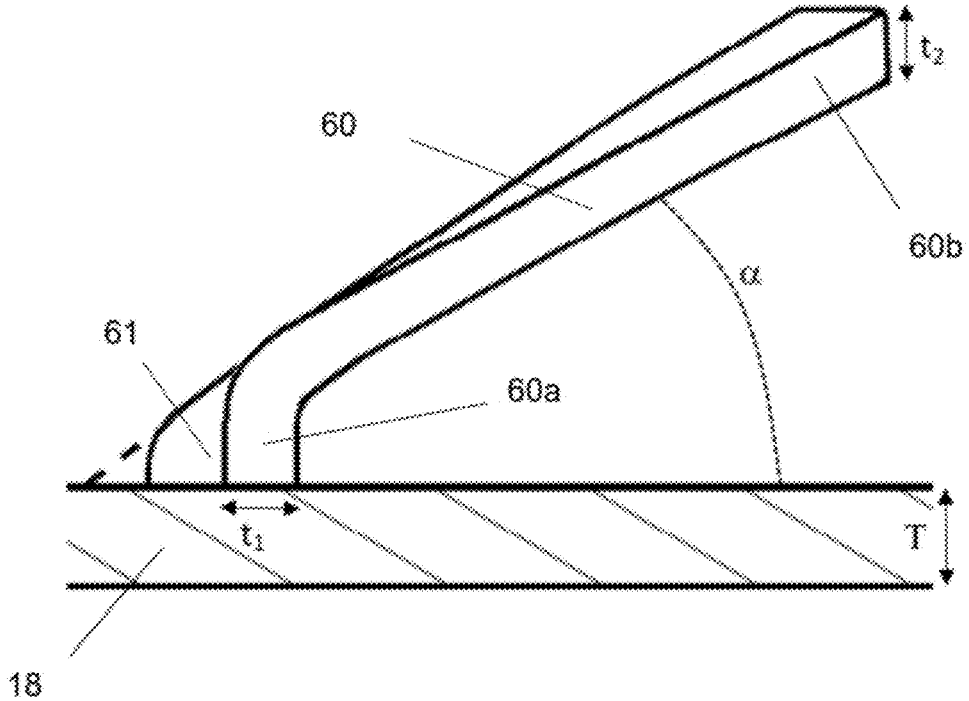
FIG. 16 is a view in the direction of arrow C in FIG. 11.

FIGS. 15 and 16 are a view in the direction of arrow B in FIG. 11, and in the direction of arrow C in FIG. 11, respectively. As can be seen, the elastic member 60 generally has an angular orientation relative to the top wall 18, wherein the angle $\alpha$ is $°<\alpha<45°$, preferably $25°\leq\alpha\leq40°$. Most preferably, the angle $\alpha$ is about 30°. Further, it should be noted that it is preferred that the thickness of the elastic means increases from the basis 60*a* to the free end 60*b* of the elastic member 60. At least, the thickness $t_2$ at the free end 60*b* should not be smaller than the thickness $t_1$ at the basis 60*a* of the elastic member 60. However, it is preferred that the thickness $t_2$ at the free end 60*b* is at least 25% higher than the thickness $t_1$ at the basis 60*a* of the elastic member. As regards the total thicknesses, the thickness $t_1$ at the basis 60*a* of the elastic member 60 should satisfy the equation:

$$t_1\leq\tfrac{2}{3}\times T$$

wherein T is the thickness of the top wall 18 of the outer cap. As a specific example, the wall thickness T of the top wall 18 could be 1.2 mm, the thickness $t_1$ at the basis 60*a* could be 0.8 mm and the thickness $t_2$ at the front end 60*b* could be 1.2 mm. In general, the thickness $t_2$ of the elastic member 60 at the free end 60*b* should be about 1 mm.

Figure 18:
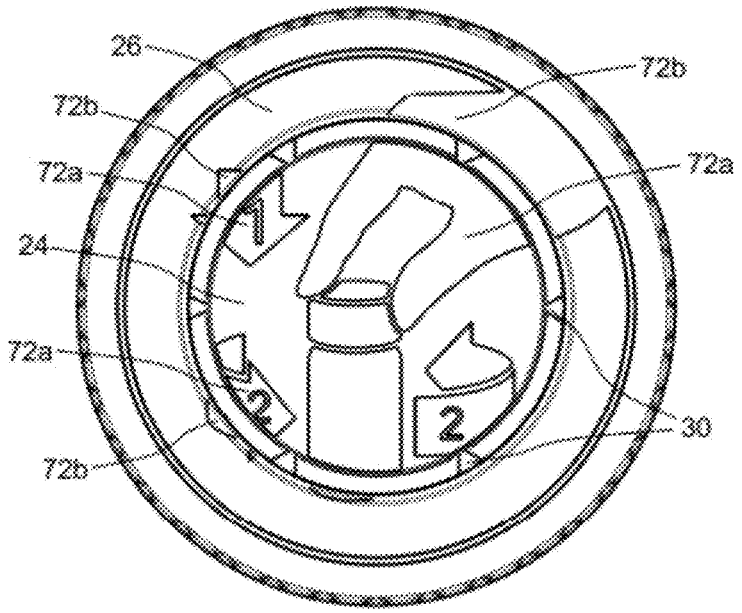

Further preferred dimensions follow from FIG. 12 which shows a top view of the elastic member according to the embodiment of FIGS. 6, 11 and 13 to 16. The width $W_0$ of the reinforcing rib 61 should satisfy the equation:

$$W_0\leq\tfrac{2}{3}\times T$$

with the thickness T of the top wall 18 of the outer cap (see FIG. 18). For example, for a thickness of the top wall T of about 1.2 mm, the width $W_0$ of the reinforcing rib 61 could be selected to be about 0.6 mm.

Finally, it was found to be advantageous to set the relative dimensions of the width $W_0$ of the reinforcing rib 61 and the width $W_1$ at the basis 60*a* of the elastic member 60 so that $W_1<W_0$.

The above-discussed preferred geometries, and especially
- the angular orientation of the elastic member,
- the increasing thickness of the elastic member from the basis 60*a* to the free end 60*b*,
- the preferred thickness of the elastic member 60 in relation to the thickness of the top wall,
- the width of the reinforcing rib, and
- the relationship between the width of the reinforcing rib 61 and the width at the basis 60*a* of the elastic member can be independently realized or be realized in any combinations thereof. The positions of the elastic members 60 and the wedge-shaped elements with the inclined surfaces 68' can be exchanged so that the elastic members are attached to the upper surface of the top wall 44 of the inner cap 14.

The noise created by the elastic members sliding over the wedge-shaped elements when turning the outer cap in the first direction to revolve once, and without applying the axial force is at least 50 dB, preferably at least 70 dB. It can be measured according to known sound level meters comprising a omnidirectional microphone, at a distance of 50 cm at most.

The axial force required to bring into engagement the first engagement means exceeds 10 N for an axial displacement of the outer cap relative to the inner cap of 1 mm. It can be measured by known advanced motorized force tester such as, for example the tester Chatillon TCD200.

Figure 19A:
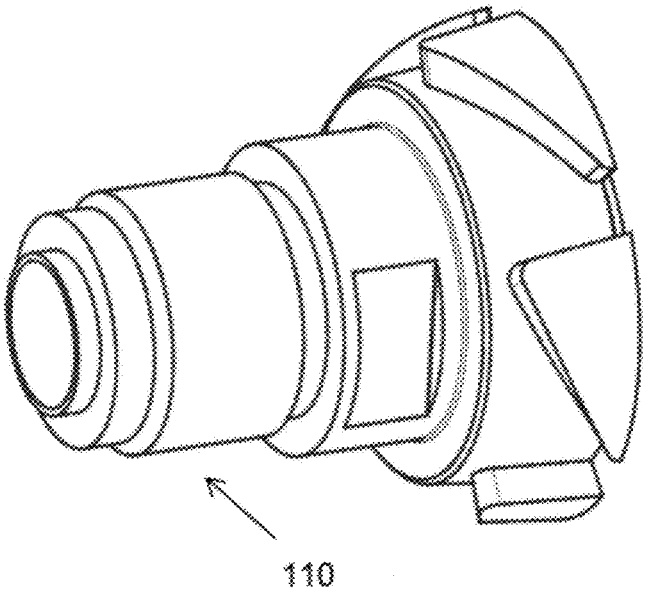
FIGS. 19*a* and 19*b* show the first part and the second part of the core of the mould, respectively.
Figure 19B:
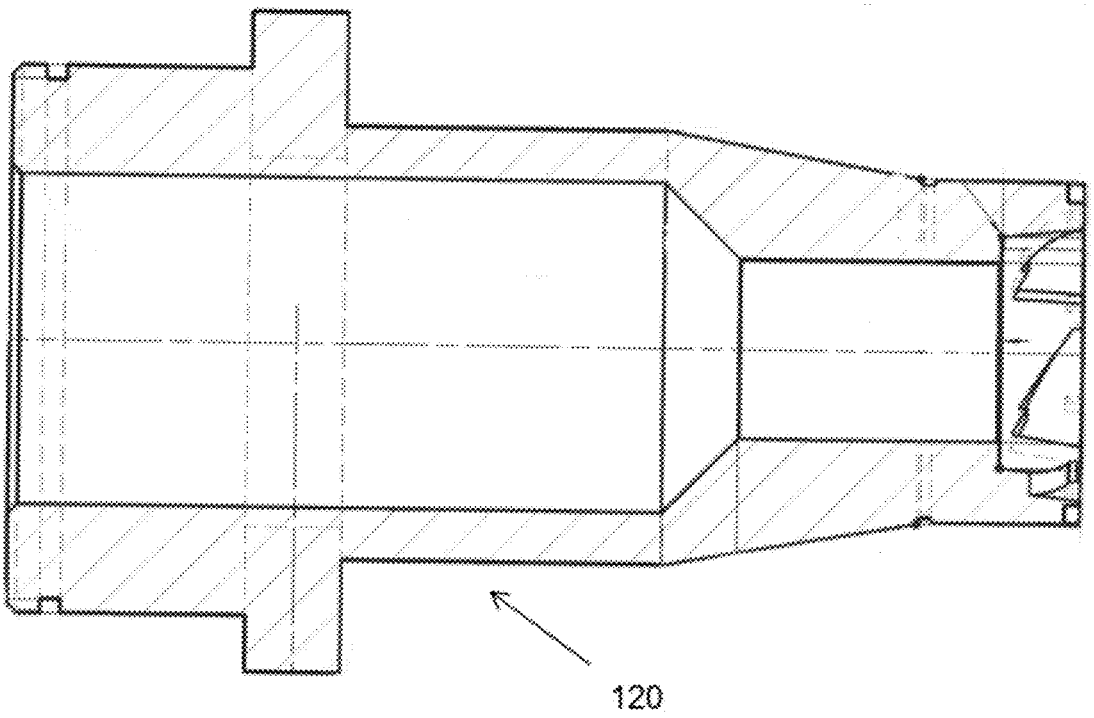
Figure 19C:
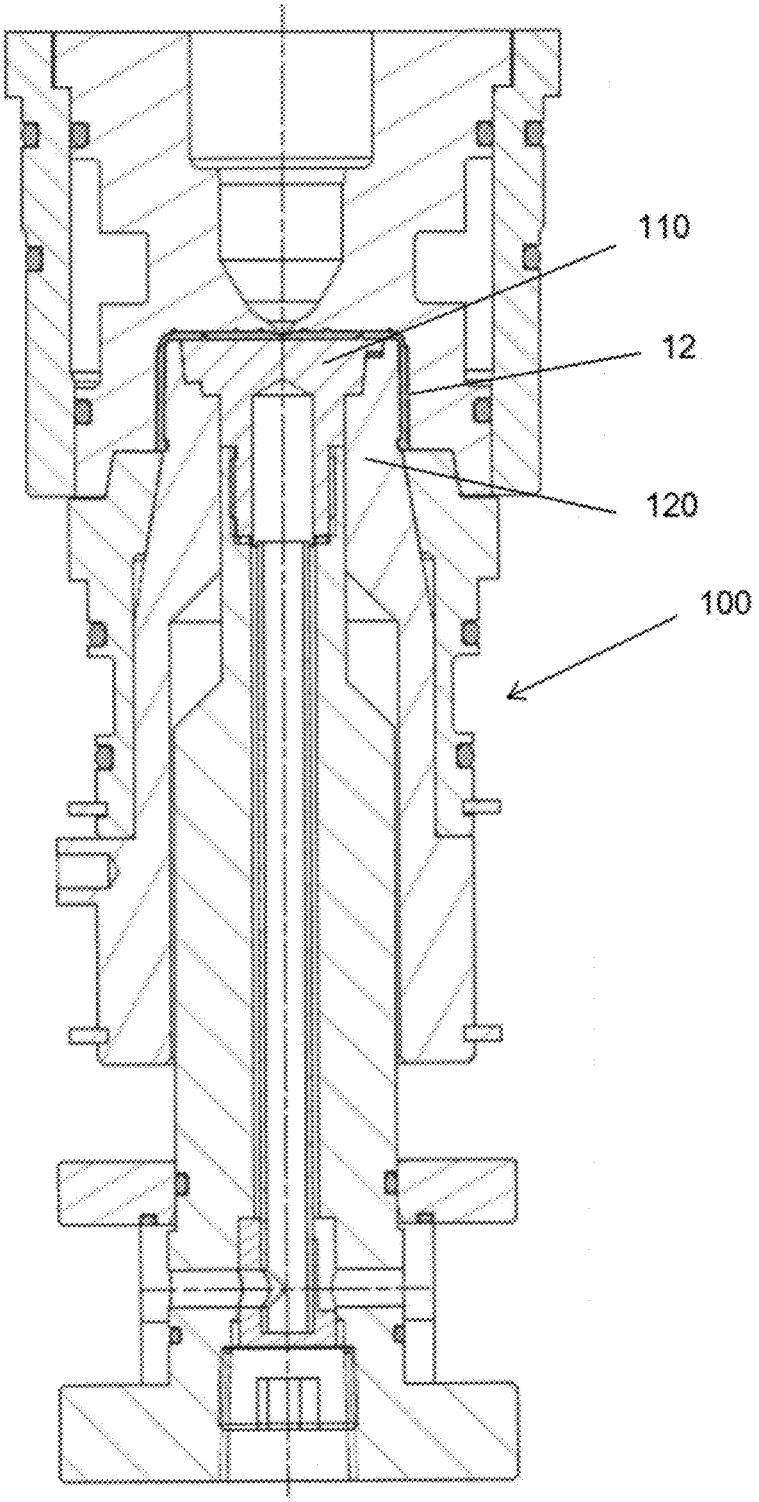
FIG. 19*c* shows the mould with the first and second part of the core and the outer cap within the mould.

No matter how the reinforcing rib 61 is shaped, the outer cap 12 with the elastic members 60 can be demolded without requiring a sliding mold. Nevertheless, due to the change of direction of the elastic members 60, which start from the top wall in a vertical direction and then run in an oblique direction, it is preferable to have a core of the mold that is in two parts for molding the internal surface of the cap. A mould 100 with a first part of the core 110 and a second part of the core 120 is shown in FIG. 19*c*, and FIGS. 19*a* and 19*b* show the first part 110 of the core and the second part 120 of the core, respectively. The first part 110 of the core of the mold 100 is on the center and includes the surface of the elastic members facing the top wall. The second part 120 of the core is an annular part which includes the cavity for the opposed surface of the elastic members. In such a way, the elastic members 60 with the curved shape as shown can be molded by first separating the outer cap 12 from the second part 120, which allows the elastic members to flex for being released from the first part 110 of the mould.

The outer cap as shown in FIG. 6 can represent the perspective top view both for the embodiment as shown in FIG. 11 and the embodiment as shown in FIG. 5 with their different shapes of the reinforcing ribs 61.

In operation, if a user turns the outer cap relative to the inner cap in an opening rotational direction without pushing down the outer cap, there will be an audible indication of the elastic members 60 which ride up the beveled surfaces 68' and then elastically snap down the step portions 69 of the wedge-shaped elements with the beveled surfaces 68'.

Once the outer cap 12 is sufficiently depressed relative to the inner cap 14, the tamper-evident member 24 will be removed from the outer cap by breaking the frangible means 30 between the top wall 18 of the outer cap 12 and the tamper-evident member 24. When further pushing down the outer cap 12 relative to the inner cap 14, the driving members 62 of the outer cap come into engagement with the serrations 66 of the inner cap so that the closure can be opened.

When closing the closure again, a user turns the outer cap in the opposite direction. The elastic members 60 abut against the step portions 69 of the wedge-shaped elements with the beveled surfaces 68' so that the inner cap 14 will be rotated together with the outer cap 12. No depression of the outer cap 12 relative to the inner cap 14 is required.

The elastic members 60 have the further function to bias the inner cap 14 and outer cap 12 away from each other in an axial direction so that the tamper-evident member 24 will not be broken without the specific application of a downward pushing force on the outer cap 12 during the first use of the closure.

Figure 17:
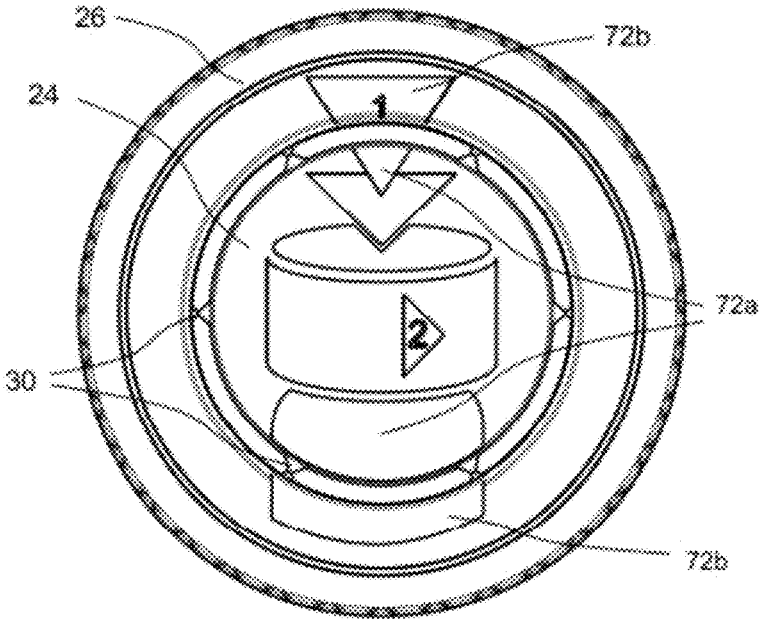
FIGS. 17 and 18 are top views of the outer cap.

The embodiments as shown in FIGS. 17 and 18 are only examples of possible designs of the top wall 18 of the outer cap 12. The closure is provided with an indication 72 which is both on the outwardly facing surface 72*a* of the tamper-evident member 24 and the outwardly facing surface 72*b* of the surrounding region 26 which is part of the top wall 18 of the outer cap 12. The indication on the surfaces 72*a* and 72*b* supplement each other in such a way that, once the tamper-evident member 24 is no more present, it becomes evident that a part of the top wall is missing and that the closure is no more tamper proof.

FIG. 18 shows a different design of the indication 72 and distinguishes from the embodiment according to FIG. 17 by the shape of the frangible means 30. In the embodiment according to FIG. 17, the frangible means 30 will break close to the surrounding region 26 which are part of the top wall 18 of the outer cap 12, whereas the substantially triangular shape of the frangible means 30 in the embodiment of FIG. 18 will lead to a breaking of the frangible means 30 at a position where the frangible means are linked to the tamper-evident member 24. Therefore, once the tamper-evident member 24 has been removed, the frangible bridges 30 still protrude out of the surrounding region 26 so that it becomes even more visible that a part of the outer cap 12 has been removed and that the container is no more tamper proof. In order to increase the visibility, it is preferable that the remaining frangible means 30 protrude at least 0.5 mm out of the surrounding region 26 and into the opening left once the tamper-evident member 24 has been removed.

Figure 20A:
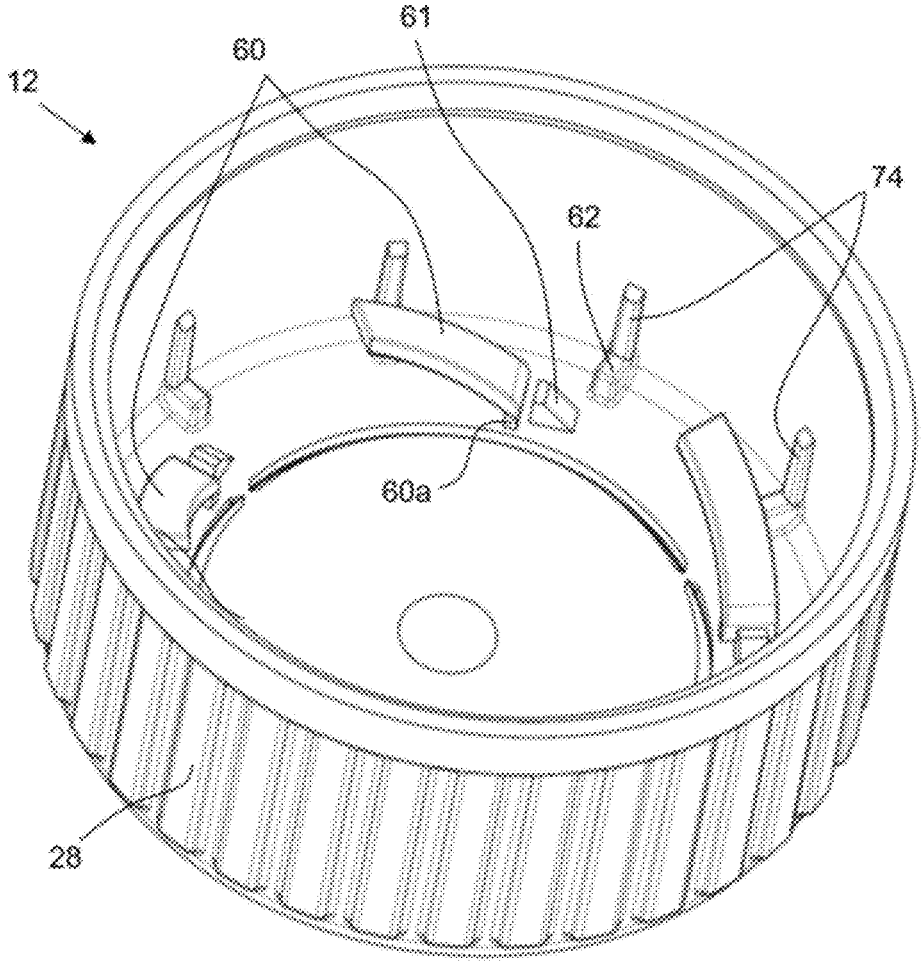
FIG. 20*a* is a bottom perspective view of the outer cap according to a further embodiment.
Figure 20B:
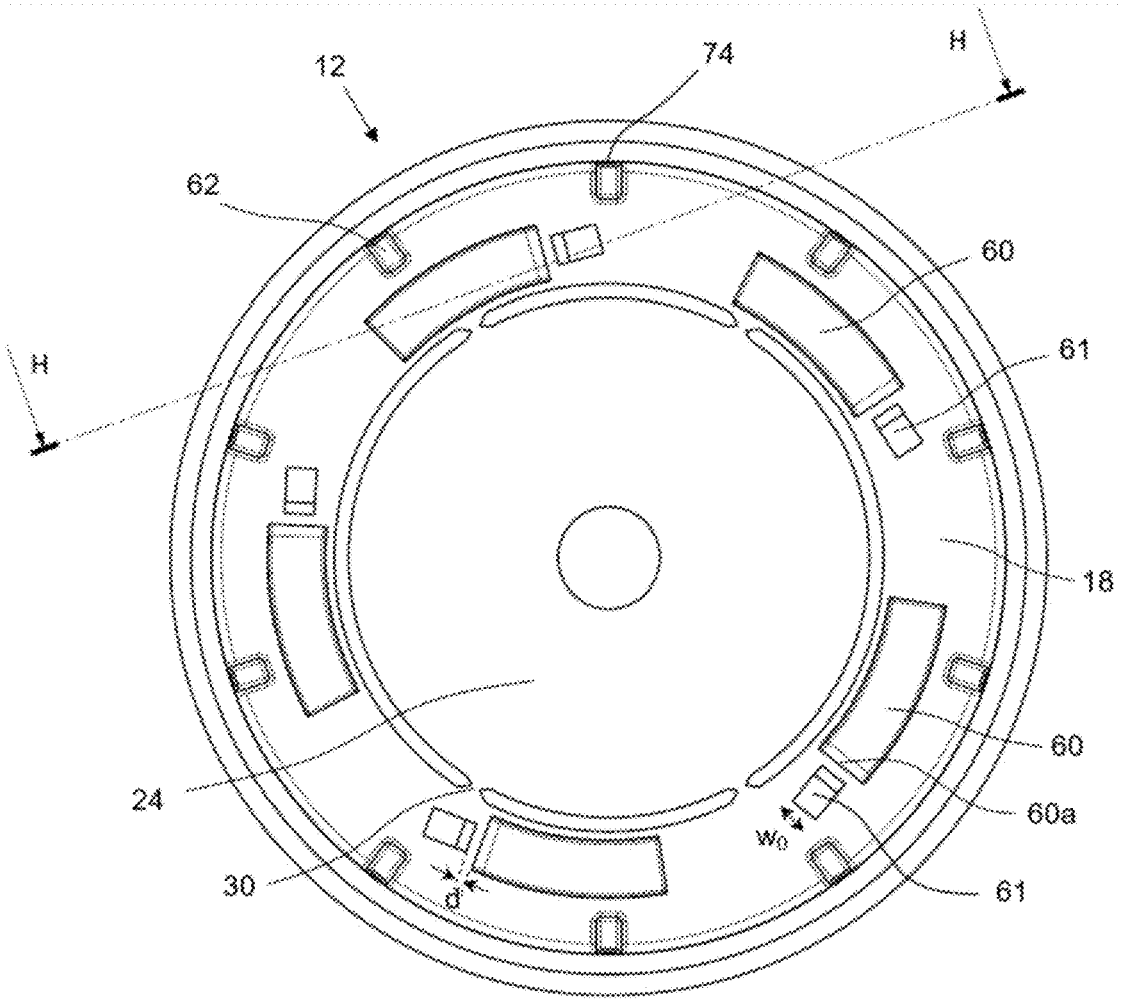
FIG. 20*b* is a bottom view of the outer cap according to the embodiment of FIG. 20*a*.
Figure 20C:
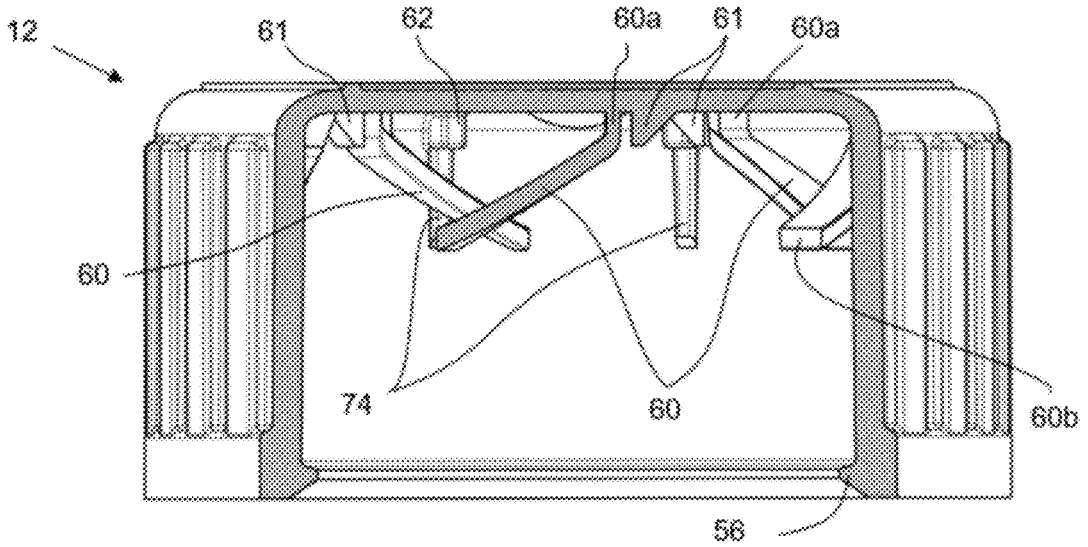
FIG. 20*c* is a cross-sectional view of the outer cap along line H-H of FIG. 20*b*.

As shown FIGS. 20*a*, 20*b* and 20*c*, the reinforcing elements 61 is attached to the top wall of the outer cap. It is arranged between the top wall and the strip-like elastic members 60 can be integrally formed with the top wall 18 with a gap or space between the reinforcing elements 61 and the corresponding elastic members 60. Such arrangement has the advantage of increasing the resistance to breakage at the base portions 60*a* of the elastic members 60 without increasing the thickness of the base portions 60*a* or decreasing the flexibility at the base portions 60*a*. Since the reinforcing elements 61 are not attached directly to the base portions 60*a* of the elastic members, they allow an increased flexibility of the base portions and only limit the amplitude of the flexing movement of a base portion towards an adjacent reinforcing element. Such arrangement allows a greater amplitude of vertical displacement of the outer cap 12 relative to an inner cap 14 compared to an outer cap 12 comprising identical reinforcing elements 61 and elastic members 60 with the reinforcing elements 61 attached to both the top wall 18 and the elastic member 60. As can be best seen in FIG. 20*c*, the wall of the reinforcing element 61 facing the base portion 60*a* of the elastic member is generally perpendicular to the top wall of the outer cap 12. The reinforcing element 61 is preferably radially centered with respect to the base portion 60*a* of the elastic member 61 which can be best seen in FIG. 20*b*. Preferably, the distance d (as shown in FIG. 20*b*) between the reinforcing element 61 and the base portion 60*a* of the elastic member is at least 0.5 mm. Preferably, the distance d as shown in FIG. 20*b* between the reinforcing element 61 and the base portion 60*a* of the elastic member 60 is not greater than the height of the straight base portion 60*a*, which height corresponds to the maximum extension of the base portion over the top wall 18 of the outer cap (before the curved transitional portion). Preferably, the width W0 of the reinforcing member is selected to fulfill the requirement W0≤⅔ T, with the wall thickness T of the top wall to which the elastic members are connected.

Both the inner cap 14 and outer cap 12 can be manufactured by means of injection moulding from a suitable plastic material. Examples of polymers usable are polyolefin-based polymers, in particular polyethylene and especially high density polyethylene, as well as polypropylene.

The material of the closure 10 as well as the material of the corresponding container has to be selected according to the specific field of application. The same applies for the use of an active agent for either trapping or releasing a gaseous component. These materials have to be selected according to the use of the container and its closure. Because of their high safety as being childproof combined with a very clear indication which makes any tampering highly evident, the container and closure are advantageously used for storing medical compositions, like tablets or capsules.

The major advantage of the inventive closure is its high versatility. It can be used for all screw-necked bottles or containers. Without any modification to a conventional screw necked bottle or container, it is possible to combine the three functions of being child resistant, tamper-evident and desiccating.

The invention claimed is:

1. An outer cap for a child-resistant closure, comprising:
a sidewall, a top wall; and
a plurality of strip-like elastic members; wherein
each strip-like elastic member comprises:
a base portion extending generally perpendicularly from the top wall;
an inclined portion being inclined relative to the top wall and ending at an end; and
a curved transitional portion connecting the base portion and the inclined portion,
wherein each elastic member further comprises a radius between the base portion and the inclined portion,
wherein the outer cap, including the strip-like elastic members, is a one-piece part,
wherein the strip-like elastic members are made of the same material as the rest of the outer cap and are integrally formed therewith, and
wherein the material of the outer cap, including the strip-like elastic members, is a polyolefin-based polymer.

2. The outer cap according to claim 1, wherein
a thickness (t1) of each of the elastic members at the base portion is $$t1 \leq \tfrac{2}{3}\, T,$$

where T is a wall thickness of the top wall to which the elastic members are connected.

3. The outer cap according to claim 1, wherein a thickness (t1) of each elastic member at the base portion is smaller than a thickness (t2) of the elastic member at the end.

4. The outer cap according to claim 1, wherein a height of the base portion in a direction perpendicular to the top wall is at least 0.3 mm.

5. The outer cap according to claim 1, further comprising, for each strip-like elastic member, a reinforcing element arranged between the top wall and the strip-like elastic member connected thereto.

6. The outer cap according to claim 1, wherein the material of the outer cap, including the strip-like elastic members, is a polymer based on polyethylene or polypropylene.

7. A child-resistant closure for a container with an outer screw thread opening, comprising:
an outer cap with a first sidewall and a first top wall; and
an inner cap with a second sidewall and a second top wall;
wherein the inner cap is coaxially nested within the outer cap and comprises an inner thread to screw the inner cap onto the container;
wherein the outer cap and the inner cap further comprise a first cooperating engagement mechanism;
wherein the first engagement mechanism is structured such that when opening the closure, the inner cap is rotated by the outer cap upon application on the outer cap of an axial force plus a turning mechanical torque in a first rotational direction; and
further comprising a second cooperating engagement mechanism arranged between the first top wall and the second top wall and structured such that when closing the closure, the inner cap is rotated by the outer cap upon application of a turning mechanical torque in a second rotational direction on the outer cap;

wherein the second cooperating engagement mechanism comprises a plurality of strip-like elastic members; wherein each elastic member comprises:

a base portion starting where the elastic member is connected to the first top wall, wherein the elastic member extends at the base portion generally perpendicular to the top wall to which it is connected;

an inclined portion ending at a second end; and a curved transitional portion connecting the base portion and the inclined portion, wherein each elastic member further comprises a radius between the base portion and the inclined portion, wherein the outer cap, including the strip-like elastic members, is a one-piece part, wherein the strip-like elastic members are made of the same material as the rest of the outer cap and are integrally formed therewith, and wherein the material of the outer cap, including the strip-like elastic members, is a polyolefin-based polymer.

8. The child-resistant closure according to claim 7, further comprising a tamper-evident element comprising a tamper-evident member that is a part of the first top wall and is connected to a surrounding region of the first top wall by a frangible component; and a protruding element, which is arranged at the first top wall facing the second top wall or arranged at the second top wall facing the first top wall so as to face the tamper-evident member.

9. The child-resistant closure according to claim 8, further comprising a weakness of a material between the tamper-evident element and the surrounding region of the first top wall.

10. The child-resistant closure according to claim 8, wherein the tamper-evident member is not circular; and wherein the outer cap comprises a first landmark element and the inner cap comprises a second landmark element, wherein the first and second landmark elements are engageable or abutable to indicate alignment of the protruding element and the tamper-evident member upon rotation of the outer cap relative to the inner cap.

11. The child-resistant closure according to claim 7, wherein the second cooperating engagement mechanism further comprises:

a plurality of wedge-shaped elements, wherein the wedge-shaped elements and the strip-like elastic members are structured such that when rotating the outer cap in the second rotational direction, the elastic members come into a locking arrangement with locking surfaces of the wedge-shaped elements so that the inner cap rotates with the outer cap in the second rotational direction.

12. The child-resistant closure according to claim 11, wherein the number of elastic members is twice the number of wedge-shaped elements, and an angle between corresponding portions of adjacent wedge-shaped elements is less than 40°.

13. The child-resistant closure according to claim 11, wherein a height of the locking surfaces of the wedge-shaped elements is at least 0.8 mm.

14. The child-resistant closure according to claim 11, wherein a noise created by the elastic members sliding over the wedge-shaped elements when turning the outer cap in the first direction without applying the axial force is at least about 50 dB.

15. The child-resistant closure according to claim 7, wherein, for each strip-like elastic member, the inclined portion is arranged at an angle to the top wall surface to which the elastic member is connected which is $$20° \leq \alpha \leq 45°.$$

16. The child-resistant closure according to claim 7, wherein, for each strip-like elastic member, a thickness (t1) of the elastic member at the base portion is $$t1 \leq 2/3\ T,$$

where T is a wall thickness of the top wall to which the elastic member is connected.

17. The child-resistant closure according to claim 7, wherein the axial force required to bring into engagement the first engagement mechanism exceeds 10 N.

18. The child-resistant closure according to claim 7, wherein the first sidewall and the second sidewall comprise cooperating locking elements to prevent a removal of the outer cap from the inner cap once assembled.

19. The child-resistant closure according to claim 18, wherein the cooperating locking elements comprise a continuous or discontinuous bead on an inner side of the first sidewall of the outer cap and a continuous or discontinuous rib or flange on an outer side of the second sidewall of the inner cap.

20. The child-resistant closure according to claim 7, further comprising a mechanism for holding an active material.

21. The child-resistant closure according to claim 7, wherein the inner cap comprises a sealing member which is configured to provide a hermetic seal between the inner cap and the opening of the container, wherein the sealing member comprises a ring-shaped inner sealing skirt with a slanted sealing surface.

22. The child-resistant closure according to claim 7, further comprising, for each strip-like elastic member, a reinforcing element arranged between the first or second top wall and the strip-like elastic member connected thereto.

23. The child-resistant closure according to claim 22, wherein, for each strip-like elastic member, the reinforcing element comprises a reinforcing rib which is arranged adjacent to the base portion between the top wall to which the elastic member is connected and the inclined portion.

24. The child-resistant closure according to claim 22, wherein, for each strip-like elastic member, the reinforcing element comprises a fortification rib, wherein a width (W0) of the fortification rib is selected to fulfill the requirement $$W0 \leq 2/3\ T,$$

wherein T is a wall thickness of the top wall to which the elastic member is connected.

25. The child-resistant closure according to claim 7, wherein the material of the outer cap, including the strip-like elastic members, is a polymer based on polyethylene or polypropylene.

* * * * *